US009315959B2

(12) United States Patent
Sekihara et al.

(10) Patent No.: US 9,315,959 B2
(45) Date of Patent: Apr. 19, 2016

(54) FOREIGN MATTER REMOVING APPARATUS AT TRACK BRANCH, AND NOZZLE USED IN THE SAME

(75) Inventors: Takanori Sekihara, Tokyo (JP); Masafumi Sato, Tokyo (JP); Junichi Chiba, Tokyo (JP); Shigeru Takahashi, Tokyo (JP); Jun Sato, Tokyo (JP); Shogo Kigami, Hyogo (JP); Takuya Suzuki, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 149 days.

(21) Appl. No.: 14/234,439

(22) PCT Filed: Jul. 26, 2012

(86) PCT No.: PCT/JP2012/004773

§ 371 (c)(1),
(2), (4) Date: May 12, 2014

(87) PCT Pub. No.: WO2013/014937

PCT Pub. Date: Jan. 31, 2013

(65) Prior Publication Data

US 2014/0298613 A1 Oct. 9, 2014

(30) Foreign Application Priority Data

Jul. 26, 2011 (JP) ..... 2011-163335
Jul. 26, 2011 (JP) ..... 2011-163601

(51) Int. Cl.

| | |
|---|---|
| ***A47L 5/38*** | (2006.01) |
| ***E01H 8/10*** | (2006.01) |
| ***E01B 19/00*** | (2006.01) |
| ***E01B 7/20*** | (2006.01) |
| ***B61L 1/20*** | (2006.01) |
| ***B61L 5/00*** | (2006.01) |

(52) U.S. Cl.
CPC . *E01H 8/105* (2013.01); *B61L 1/20* (2013.01); *B61L 5/00* (2013.01); *E01B 7/20* (2013.01); *E01B 19/00* (2013.01); *A47L 5/38* (2013.01)

(58) Field of Classification Search
CPC ..... E01B 7/00; E01B 7/20; E01B 19/00; B61L 1/20; B61L 5/00; A47L 5/38
USPC ..... 15/301
IPC ..... A47L 5/38
See application file for complete search history.

(56) References Cited

U.S. PATENT DOCUMENTS 4,767,061 A 8/1988 Ingemansson

FOREIGN PATENT DOCUMENTS

JP S63-500223 A 1/1988
JP H06-240605 A 8/1994

(Continued)

OTHER PUBLICATIONS

International Search Report from the International Bureau of WIPO for International Application No. PCT/JP2012/004773 dated Nov. 6, 2012 (2 pages) and an English translation of the same (2 pages).

(Continued)

*Primary Examiner* — David Redding
(74) *Attorney, Agent, or Firm* — Fitch Even Tabin & Flannery LLP

(57) ABSTRACT

Provided is a foreign matter removing apparatus at a track branch, and a nozzle used in this apparatus that are capable of sufficiently securing foreign matter removing performance as well as significantly reducing generation of noises. In the nozzle for the foreign matter removing apparatus at a track branch, compressed air supplied from piping is injected from each nozzle element. Slits are formed in each nozzle element, a sloped portion is formed at a front end of the nozzle element, and this sloped portion opposes a tongue rail.

8 Claims, 22 Drawing Sheets

(56) References Cited

FOREIGN PATENT DOCUMENTS

| | | | |
|---|---|---|---|
| JP | H07-054317 | A | 2/1995 |
| JP | 2010-007423 | A | 1/2010 |

OTHER PUBLICATIONS

International Preliminary Report on Patentability (Chapter I of the Patent Cooperation Treaty) from the International Bureau of WIPO for International Application No. PCT/JP2012/004773 dated Jan. 28, 2014, 7 pages.

FOREIGN MATTER REMOVING APPARATUS AT TRACK BRANCH, AND NOZZLE USED IN THE SAME

CROSS-REFERENCE TO RELATED APPLICATIONS

This application is a U.S. national phase application filed under 35 U.S.C. §371 of International Application PCT/JP2012/004773, filed on Jul. 26, 2012, designating the United States, which claims priority from Japanese Application Number 2011-163335, filed Jul. 26, 2011, and Japanese Application Number 2011-163601, filed Jul. 26, 2011, which are hereby incorporated herein by reference in their entirety.

TECHNICAL FIELD

The present invention relates to a foreign matter removing apparatus for removing foreign matters in the vicinity of a track branch of a railway through air injection, and to a nozzle used in this apparatus. Particularly, the present invention relates to a foreign matter removing apparatus at a track branch for removing foreign matters in the vicinity of a tongue rail through air injection, and to a nozzle used in this apparatus.

BACKGROUND ART

There has been known such a conventional problem that, when vehicles pass through a track branch, frozen snow drops down due to vibrations of the vehicles, or dropping frozen snow hits ballast, so that the ballast jumps up as scattered stones or the like; and thus the dropping frozen snow or the scattered stones may be caught between a stock rail and a tongue rail, which hinders switching of the tongue rail. Hence, various developments and studies have been conducted on foreign matter removing apparatuses for use at a track branch.

For example, Japanese Patent Laid-Open No. H07-054317 discloses a foreign matter removing apparatus at a track branch that removes foreign matters between a stock rail and a tongue rail so as to prevent switching of the track branch from being disable due to dropping frozen snow or scattered stones.

The foreign matter removing apparatus at a track branch described in Japanese Patent Laid-Open No. H07-054317 is a foreign matter removing apparatus at a track branch that removes foreign matters having dropped between the stock rail and the tongue rail at the track branch, wherein each piping unit is installed to a side surface of the stock rail opposing the tongue rail in accordance with a length of the branch track, air injection nozzle units each having multiple injection ports are disposed at multiple positions with intervals in the longitudinal direction of this piping unit such that the injection orientation of each nozzle unit is slightly directed to the tongue rail, a pressured air source device is provided in the vicinity of the track branch, and the pressured air source device is connected to each pressured air supply passage through an opening/closing switching mechanism thereof so as to supply the pressured air to each piping unit.

Japanese Patent Laid-Open No. 2010-007423 discloses a foreign matter removing apparatus at a track branch capable of removing foreign matters between rails at a crossing section of the track branch.

The foreign matter removing apparatus at a track branch described in Japanese Patent Laid-Open No. 2010-007423 is installed at a track branch including stock rails, and tongue rails that can come into contact with or apart from the stock rails, and removes foreign matters having dropped between the rails by injecting compressed air, wherein this foreign matter removing apparatus is disposed at a crossing section where rails intersect each other, which is located at a backward position opposite to a frontward position of the track branch where the stock rail and the tongue rail are able to come into contact with each other, and the foreign matter removing apparatus includes a nozzle unit for injecting compressed air, and an air supply device for supplying the compressed air to the nozzle unit, wherein the nozzle unit is disposed in the frontward position in the crossing section, and includes injection ports having apertures for injecting the compressed air backward in the crossing section.

Both the foreign matter removing apparatuses of Japanese Patent Laid-Open No. H07-054317 and Japanese Patent Laid-Open No. 2010-007423 at the track branches are very useful for removing dropping frozen snow and scattered stones.

SUMMARY OF INVENTION

Japanese Patent Laid-Open No. H07-054317 discloses an injection port having a round hole as an air injection port 17 of the nozzle unit 3, and Japanese Patent Laid-Open No. 2010-007423 discloses a large-diameter injection port 22 and a small-diameter injection port 23 at the crossing section.

In both cases of using the air injection port 17 of Japanese Patent Laid-Open No. H07-054317 and the small-diameter injection port 23 of Japanese Patent Laid-Open No. 2010-007423, there is such a problem that these injection ports are difficult to be installed at locations near private houses in the neighbor because of noises caused by injecting the compressed air. Consequently, although installation of these apparatuses has been desired in many areas and many places, progress in installation of the apparatuses is still insufficient in these places.

The nozzle unit of the foreign matter removing apparatus described in Japanese Patent Laid-Open No. 2010-007423 includes a number of small-diameter injection ports and three large-diameter injection ports, as shown in FIG. 4 of Japanese Patent Laid-Open No. 2010-007423. There is such a problem that this apparatus is difficult to be installed at a place in the vicinity of private houses in the neighbor because of noises caused at the time of injecting the compressed air from these many small-diameter injection ports. As a result, although installation of this apparatus has been desired in many areas and in many places, progress in installation of this apparatus is still insufficient in these places.

An object of the present invention is to provide a foreign matter removing apparatus at a track branch, and a nozzle used in this apparatus which are capable of sufficiently securing foreign matter removing performance as well as significantly reducing generated noises.

(1)

A foreign matter removing apparatus at a track branch according to one aspect of the present invention is a foreign matter removing apparatus at a track branch for removing foreign matters having dropped between a stock rail and a tongue rail at the track branch, the foreign matter removing apparatus including: a piping unit for supplying compressed air; and at least one injection nozzle element for injecting the compressed air supplied from the piping unit; wherein the injection nozzle element includes: a cylindrical housing disposed on an opposite side of the injection nozzle element to the tongue rail, and having a sloped portion approaching more closely to the stock rail toward a nozzle front end of the injection nozzle element; and slits extending through an inside of the cylindrical housing in a central axis direction thereof so as to inject the compressed air, at least some of the slits opening in the sloped portion, and none of the slits opening toward the stock rail, and a central axis of the injection nozzle element is oriented from a direction along the stock rail toward the tongue rail at a predetermined angle.

In the foreign matter removing apparatus at a track section, the compressed air supplied from the piping unit is injected from the slits extending through the inside in the central axis direction, and at least some of the slits open in the sloped portion, and none of the slits open toward the stock rail. The cross sectional shape of each slit may be oval in addition to rectangular.

The present inventors have found that noises are caused because of the air injection port 17 of Japanese Patent Laid-Open No. H07-054317 and the small-diameter injection port 23 of Japanese Patent Laid-Open No. 2010-007423 both having simple round holes.

In addition, it has been confirmed through an experiment that, if configuring a nozzle to have a conical shape, and also configuring each injection port supplying the compressed air to have a slit shape that opens in its conical side surface, it is possible to sufficiently secure the injection pressure while greatly reducing the noises, compared with the case of using the injection ports injecting the compressed air each having a simple round hole. Despite this, if this finding is directly applied to the foreign matter removing apparatus at a track branch, the injected compressed air collides with the stock rail, which causes the noises.

By using such slits that extend through the inside in the central axis direction, at least some of which open in the sloped portion, but none of which open in the surface thereof facing the stock rail, the slits or some of the slits opening in the sloped portion attain the same foreign matter removing effect as that of the slits opening in the conical side surface, as well as the injection pressure can be sufficiently secured while greatly reducing the noises.

On the other hand, because no slits open in the surface thereof opposite to the stock rail, the same effect as that of the slits opening in the conical side surface cannot be attained, but the injected compressed air is prevented from colliding with the stock rail, thereby reducing the noises caused by the collision.

The sloped portion may be a plane surface or a curved surface, and the cross sectional shape of each slit may be rectangular, oval, or polygonal including' triangle.

(2)

In the foreign matter removing apparatus at a track branch, the sloped portion may be formed by a plane surface extending from a top surface of the cylindrical housing toward a circumferential side surface thereof.

In this case, since only beveling is required at the time of machining the injection nozzle element, it is possible to reduce generation of the noises while significantly reducing production cost compared with the case of machining of a curved surface such as a conical shaped side surface. Specifically, the position and the dimension of each slit opening in the sloped portion become changed through the beveling, but the slits are obliquely cut, which is similar to the case of the curved surface, so that it is possible to sufficiently secure the injection pressure while significantly reducing the noises.

(3)

In the foreign matter removing apparatus at a track branch, the piping unit may include a rectangular tube disposed on a side surface of the stock rail opposite to the tongue rail, the injection nozzle element may be disposed to one or both of an upper side and a lower side of the piping unit, and the plane surface of the sloped portion may be provided within a projected area on an upper surface or on a bottom surface of the piping unit.

In this case, it is possible to prevent, interference with the tongue rail while securing installation space for the injection nozzle element.

(4)

In the foreign matter removing apparatus at a track branch, the slits may be radially arranged at multiple positions around an axial center of the cylindrical housing.

In this case, it is possible to secure a greater distance between the two adjacent slits compared with the case of arranging the slits in the top surface of the cylindrical housing in a grid form. As a result, the compressed air injected from each slit hardly interferes each other, and the air flow can be prevented from being disturbed, thereby further reducing the noises. Each slit may have a cross sectional shape of a rectangle or an oval alone, or in combination thereof.

(5)

In the foreign matter removing apparatus at a track branch, a plurality of the injection nozzle elements each having the same shape may be provided, and one of the injection nozzle elements may have an injection direction different from an injection direction of another of the injection nozzle elements.

In this case, by setting the injection direction of each injection nozzle element to be different from each other, it is possible to increase the injection area, to secure the removal of foreign matters in a wide range, and to commonly use the injection unit, which makes it easier to manage product components on the manufacturing basis.

(6)

A nozzle for a foreign matter removing apparatus at a track branch according to another aspect of the present invention is a nozzle for a foreign matter removing apparatus at a track branch mounted at a track branch of rails so as to remove foreign matters having dropped between rails by injecting compressed air, the nozzle for a foreign matter removing apparatus at a track branch including: an injection housing of a conical trapezoid disposed at a front position of a crossing section where the rails intersect each other; one or multiple slits formed in a side surface of the injection housing so as to inject the compressed air toward a back position of the crossing section; and a guide unit for guiding the compressed air from a compressed air introduction port of the injection housing through an inside of the injection housing to the one or multiple slits.

The present inventors have found that noises are caused because of the air injection port 17 of Japanese Patent Laid-Open No. H07-054317 and the small-diameter injection port 23 of Japanese Patent Laid-Open No. 2010-007423 both having simple round holes.

In addition, it has been confirmed through an experiment that, if configuring a nozzle to have a conical shape, and also configuring each injection port supplying the compressed air to have a slit shape that opens in its conical side surface, it is possible to sufficiently secure the injection pressure while greatly reducing the noises, compared with the case of using the injection ports injecting the compressed air each having a simple round hole. Based on this finding, further improvement has been made which has disposed a guide unit inside the injection housing. Specifically, it is possible to allow the compressed air to flow along the guide unit, thereby reducing abrupt collision of the compressed air with the inner wall of the injection housing, and suppressing disturbance of the air flow injected from the slits. Accordingly, it is possible to significantly reduce the noises caused by injecting the compressed air while maintaining the pressure at the time of injecting the compressed air.

The cross sectional shape of each slit may be an oval, or a polygon including a triangle other than a rectangle.

(7)

In the nozzle for a foreign matter removing apparatus at a track branch, the guide unit may have a conical shape.

The guide unit may be formed in a pyramid shape, a simple sloped surface, or a curved slope surface other than a conical shape. If a number of slits are provided, and each slit has a conical shape, it is possible to more uniformly flow the compressed air to each slit along the conical portion compared with the case of using a guide unit having a pyramid shape or the like, so that abrupt collision of the compressed air with the inner wall of the injection housing can be reduced, thereby suppressing disturbance of the air flow injected from each slit formed in the side surface. Accordingly, it is possible to greatly reduce the noises caused by injecting the compressed air.

(8)

A nozzle used in a foreign matter removing apparatus at a track branch according to another aspect of the present invention is a nozzle used in a foreign matter removing apparatus at a track branch for removing foreign matters having dropped between a stock rail and a tongue rail at the track branch, the nozzle including: a piping unit for supplying compressed air; and at least one injection nozzle element for injecting the compressed air supplied from the piping unit; wherein the injection nozzle element includes: a cylindrical housing disposed on an opposite side of the injection nozzle element to the tongue rail, and having a sloped portion approaching more closely to the stock rail toward a nozzle front end of the injection nozzle element; and slits extending through an inside of the cylindrical housing in a central axis direction thereof so as to inject the compressed air, at least some of the slits opening in the sloped portion, and none of the slits opening toward the stock rail, and a central axis of the injection nozzle element is oriented from a direction along the stock rail toward the tongue rail at a predetermined angle.

In the nozzle used in the foreign matter removing apparatus at the track branch, the compressed air supplied from the piping unit is injected from the slits extending through the inside in the central axis direction, and at least some of the slits open in the sloped portion, and none of the slits open toward the stock rail. The cross sectional shape of each slit may be oval in addition to rectangular.

The present inventors have found that noises are caused because of the air injection port 17 of Japanese Patent Laid-Open No. H07-054317 and the small-diameter injection port 23 of Japanese Patent Laid-Open No. 2010-007423 both having simple round holes.

In addition, it has been confirmed through an experiment that, if configuring a nozzle to have a conical shape, and also configuring each injection port supplying the compressed air to have a slit shape that opens in its conical side surface, it is possible to sufficiently secure the injection pressure while greatly reducing the noises, compared with the case of using the injection ports injecting the compressed air each having a simple round hole. Despite this, if this finding is directly applied to the nozzle used in the foreign matter removing apparatus at a track branch, the injected compressed air collides with the stock rail, which causes the noises.

By using such slits that extend through the inside in the central axis direction, at least some of which open in the sloped portion, but none of which open in the surface facing the stock rail, the slits or some of the slits opening in the sloped portion attain the same foreign matter removing effect as that of the slits opening in the conical side surface, as well as the injection pressure can be sufficiently secured while greatly reducing the noises.

On the other hand, because no slits open in the surface facing the stock rail, the same effect as that of the slits opening in the conical side surface cannot be attained, but the injected compressed air is prevented from colliding with the stock rail, thereby reducing the noises caused by the collision.

The sloped portion may be a plane surface or a curved surface, and the cross sectional shape of each slit may be rectangular, oval, or polygonal including triangle.

DESCRIPTION OF THE EMBODIMENTS

Embodiments according to the present invention will be described with reference to drawings, hereinafter. In the first and second embodiments, a foreign matter removing apparatus at a track branch and a nozzle used in this apparatus will be described by using examples of applying them to a track for Shinkansen. The foreign matter removing apparatus at a track branch and the nozzle used in this apparatus may be applicable not only to a track for Shinkansen, but also to other tracks, such as tracks for existing railways, etc.

First Embodiment

Configuration of Track Branch

Figure 1:
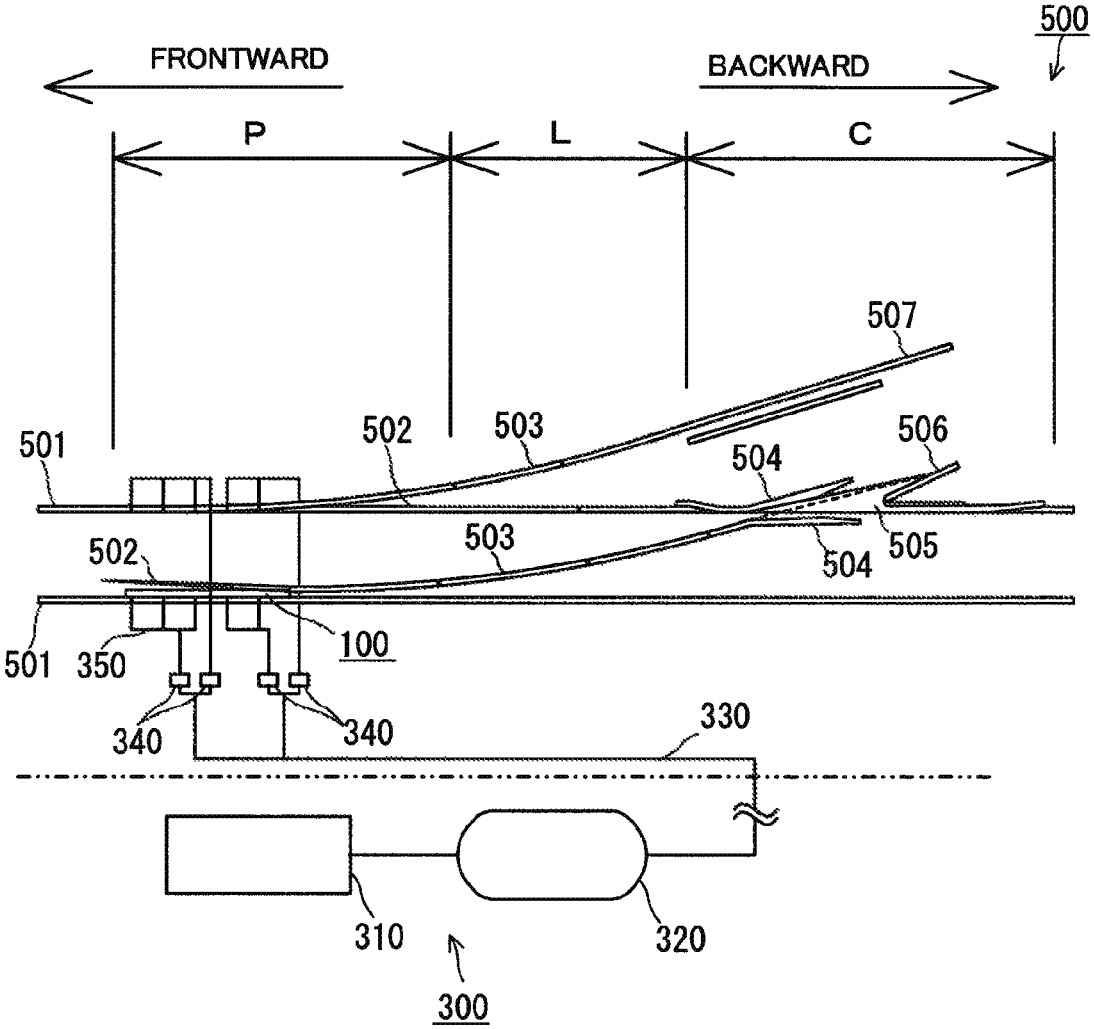
FIG. 1 is a schematic plan view showing an example of a configuration of a track branch according to the first embodiment.

FIG. 1 is a schematic plan view showing an example of a configuration of a track branch 500 according to the first embodiment. As shown in FIG. 1, the track branch 500 are segmented into each region (point section P, lead section L, and crossing section C) in the track direction.

As shown in FIG. 1, the track branch mainly includes a pair of stock rails 501, a pair of tongue rails 502, lead rails 503, wing rails 504, a movable rail 505, a fixing member 506, and main rails 507.

The point section P of FIG. 1 is configured as a region including a portion where the stock rails 501 come into contact with the tongue rails 502 at the front position of the track branch 500.

The crossing section C is configured as a region where the wing rails 504, the movable rail 505, and the fixing member 506 are disposed at the back position of the track branch 500.

The lead section L is configured as a region between the point section P and the crossing section C where the lead rails 503 are disposed at a portion where the point section P and the crossing section C are connected to each other.

In the present embodiment, the point section P and the leading section L form a frontward section located at the front position of the track branch 500, and the crossing section C is located at a backward section of the track branch 500 opposite to the frontward section, and forms a region including a portion where the rails intersect each other.

As shown in FIG. 1, the pair of the stock rails 501 are installed in accordance with a wheel width of a railway vehicle traveling over the rails with a constant distance therebetween. The pair of tongue rails 502 capable of coming into contact with or apart from the pair of the stock rails 501 are installed so as to allow the vehicle to start branching away from the stock rails 501.

The stock rails 501 at the track branch 500 shown in FIG. 1 are disposed on railway sleepers via floor boards. The tongue rails 502 are configured to be movable on the railway sleepers via bearing floor boards. This configuration allows each tongue rail 502 to come into contact with or apart from the stock rail 501.

In general, at the track branch, a railway point (not shown) operates in accordance with an instruction from a controller (not shown) so that each tongue rail 502 moves in the direction of coming into contact with or apart from the stock rails 501, thereby carrying out a switching operation (point switching operation) on the traveling rails at the track branch 500. Accordingly, the railway vehicle can travel in the direction of the branch track line, or in the direction of the main track line.

(Configuration of Foreign Matter Removing Apparatus)

A configuration of a foreign matter removing apparatus 300 equipped with a nozzle for the foreign matter removing apparatus 100 according to the first embodiment will be described hereinafter.

The nozzle for the foreign matter removing apparatus 100 is disposed between the stock rail 501 and the tongue rail 502 at the track branch 500, as described above. The foreign matter removing apparatus 300 equipped with the nozzle for the foreign matter removing apparatus 100 according to the present embodiment removes foreign matters such as snow and scattered stones having dropped between the stock rail 501 and the tongue rail 502 by injecting compressed air from the nozzle for the foreign matter removing apparatus 100.

As shown in FIG. 1, the foreign matter removing apparatus 300 mainly includes an air supply device 310, compression air tank 320, the nozzle for the foreign matter removing apparatus 100, air piping 330, an electromagnetic switching valve 340, and nozzle piping 350.

The air supply device 310 shown in FIG. 1 is a compressed air supply device such as a compressor. Compressed air supplied from the air supply device 310 is accumulated in the compression air tank 320, and is supplied to the nozzle for the foreign matter removing apparatus 100 via the air piping 330 and the nozzle piping 350 if the electromagnetic switching valve 340 is released.

Specifically, the controller (not shown) transmits a switching instruction for the electromagnetic switching valve 340 based on operation instruction signals transmitted from various equipment such as an operation signal of the railway point (point switching signal), or based on detection results from various sensors, such as a fall sensor (not shown) for fall of snow and foreign matters and a snowfall sensor (not shown). As a result, compressed air is injected from the nozzle for the foreign matter removing apparatus 100 so as to remove the foreign matters. In response to the above point switching signal, a front end portion of each tongue rail 502 comes into contact with or apart from the stock rail 501, and the movable rail 505 comes into contact with or apart from the wing rail 504.

(Nozzle for Foreign Matter Removing Apparatus)

Figure 2:
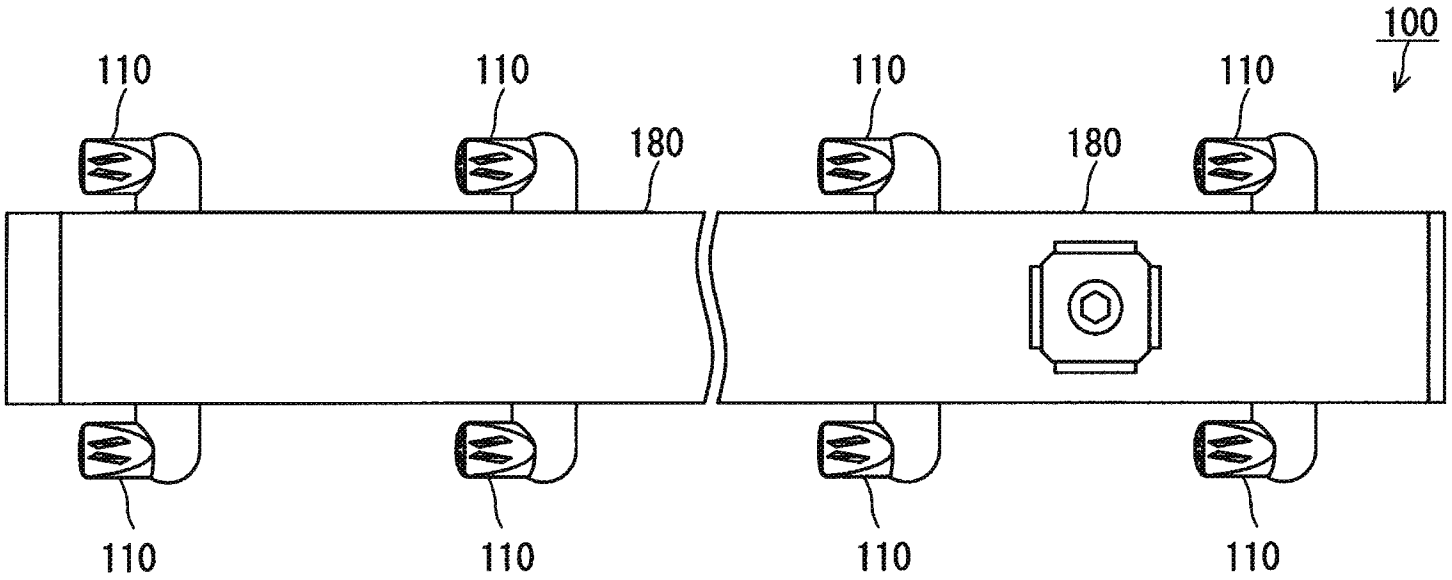
FIG. 2 is a schematic diagram showing an example of a nozzle for a foreign matter removing apparatus viewed from a side surface thereof.
Figure 3:
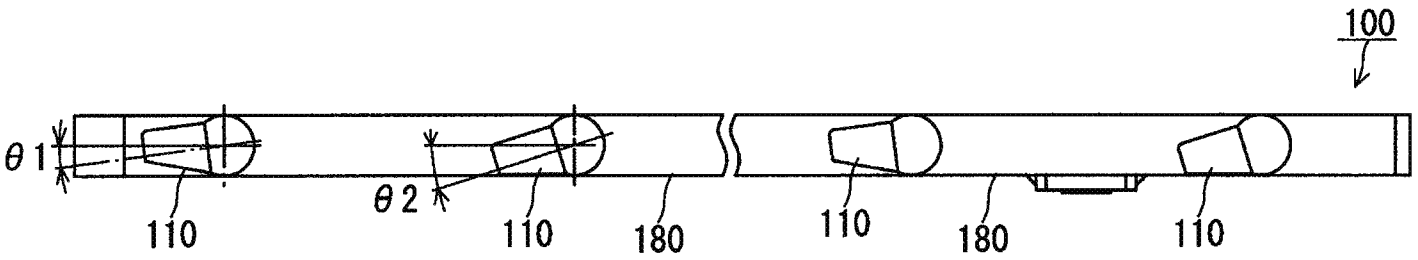
FIG. 3 is a schematic diagram showing the nozzle for the foreign matter removing apparatus viewed from a top thereof.
Figure 4:
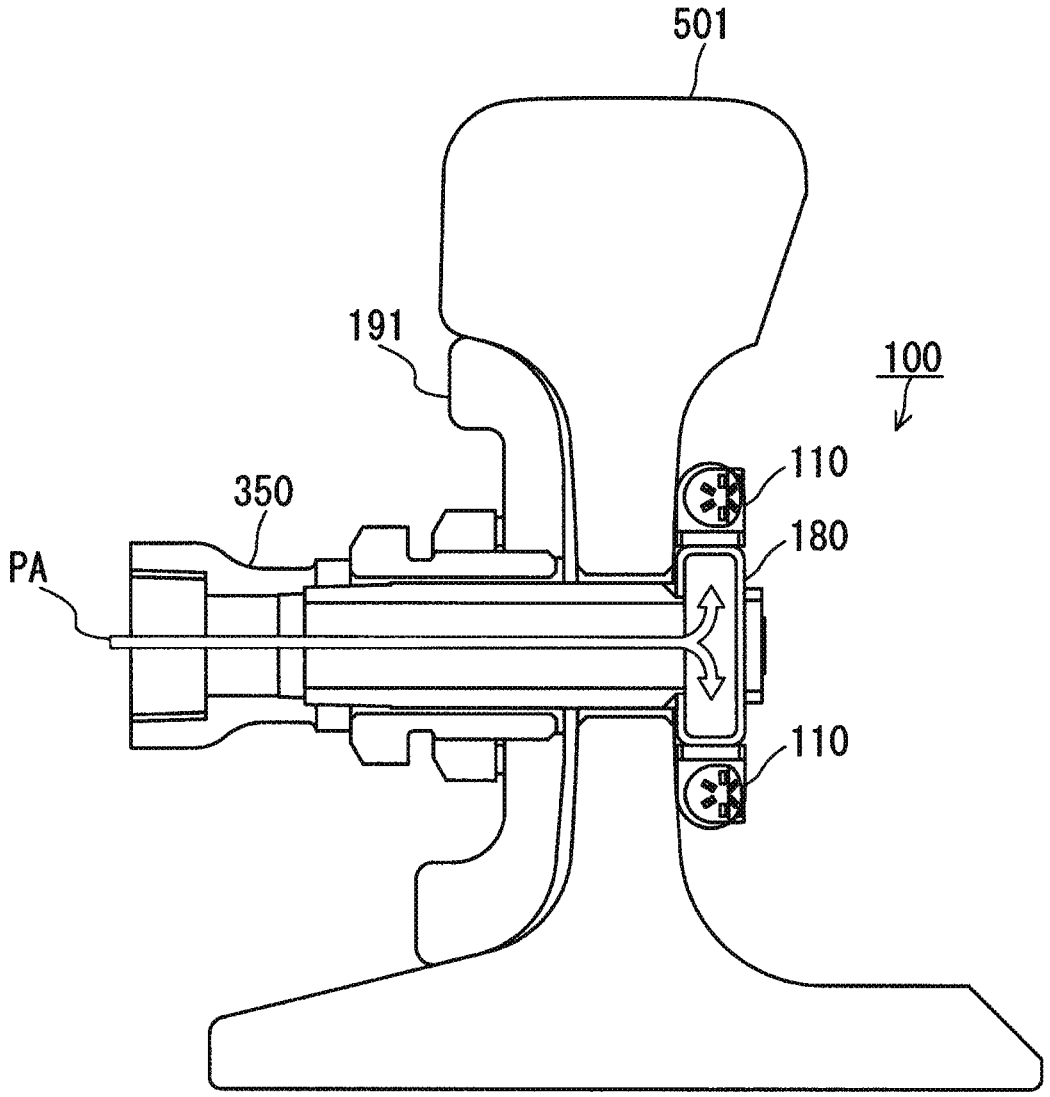
FIG. 4 is a schematic cross sectional view showing the nozzle for the foreign matter removing apparatus mounted to a stock rail.

FIG. 2 is a schematic diagram showing an example of the nozzle for the foreign matter removing apparatus 100 viewed from a side surface thereof, FIG. 3 is a schematic diagram showing the nozzle for the foreign matter removing apparatus 100 viewed from a top thereof, and FIG. 4 is a schematic cross sectional view showing the nozzle for the foreign matter removing apparatus 100 mounted to the stock rail 501.

As shown in FIG. 2 and FIG. 3, the nozzle for the foreign matter removing apparatus 100 includes nozzle elements 110 and piping 180. As shown in FIG. 2 to FIG. 4, the piping 180 is formed by a rectangular tube having a hollow space thereinside, and compressed air PA supplied from the nozzle piping 350 is supplied to each nozzle element 110. The nozzle elements 110 are disposed on upper and lower surfaces of the piping 180 with predetermined intervals.

As shown in FIG. 2 and FIG. 3, a plurality of the nozzle elements 110 are disposed on the upper surface, and also on the bottom surface at corresponding positions to those on the upper surface; and each nozzle element disposed on the upper surface has the same shape, and each nozzle element disposed on the bottom surface also has the same shape. Among the nozzle elements 110 disposed on the upper and lower surfaces of the piping 180, the nozzle elements 110 on the upper surface of the piping 180 are tilted toward the tongue rail 502 by an angle θ1 and by an angle θ2, alternately. The angle θ1 is within a range of 5° or more to 10° or less, and preferably 7.5°; and the angle θ2 is within a range of more than 10° to 20° or less, and preferably 17.5'. The nozzle element 110 will be described in detail later.

As shown in FIG. 4, the nozzle for the foreign matter removing apparatus 100 is mounted to the stock rail 501 on the side facing the tongue rail 502 using a mounting member 191. The nozzle for the foreign matter removing apparatus 100 is installed so as not to project from a recessed portion of the stock rail 501. Specifically, wheels of a railway vehicle do not come into contact with the nozzle for the foreign matter removing apparatus 100 when the wheels pass over the stock rail 501.

As shown in FIG. 4, in the nozzle for the foreign matter removing apparatus 100, the compressed air PA supplied from the nozzle piping 350 flows in a direction indicated by the arrows, and is supplied to the nozzle elements 110 through the piping 180.

(Structure of Nozzle)

Figure 5:
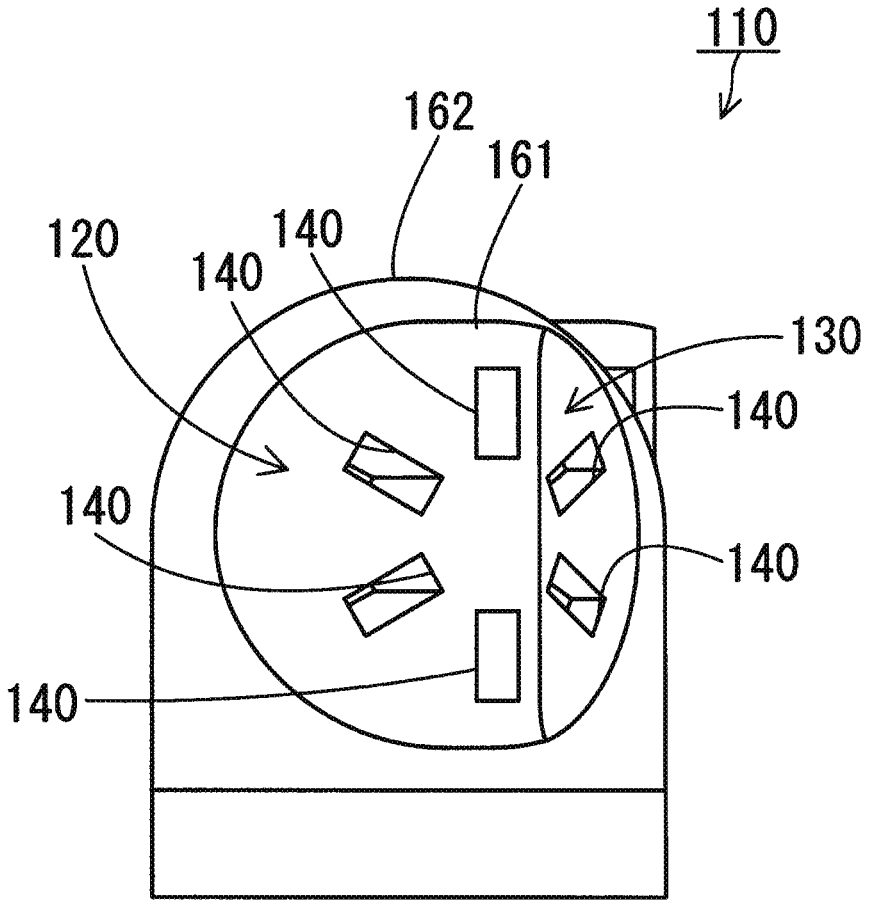
FIG. 5 is a front view showing details of a nozzle.
Figure 6:
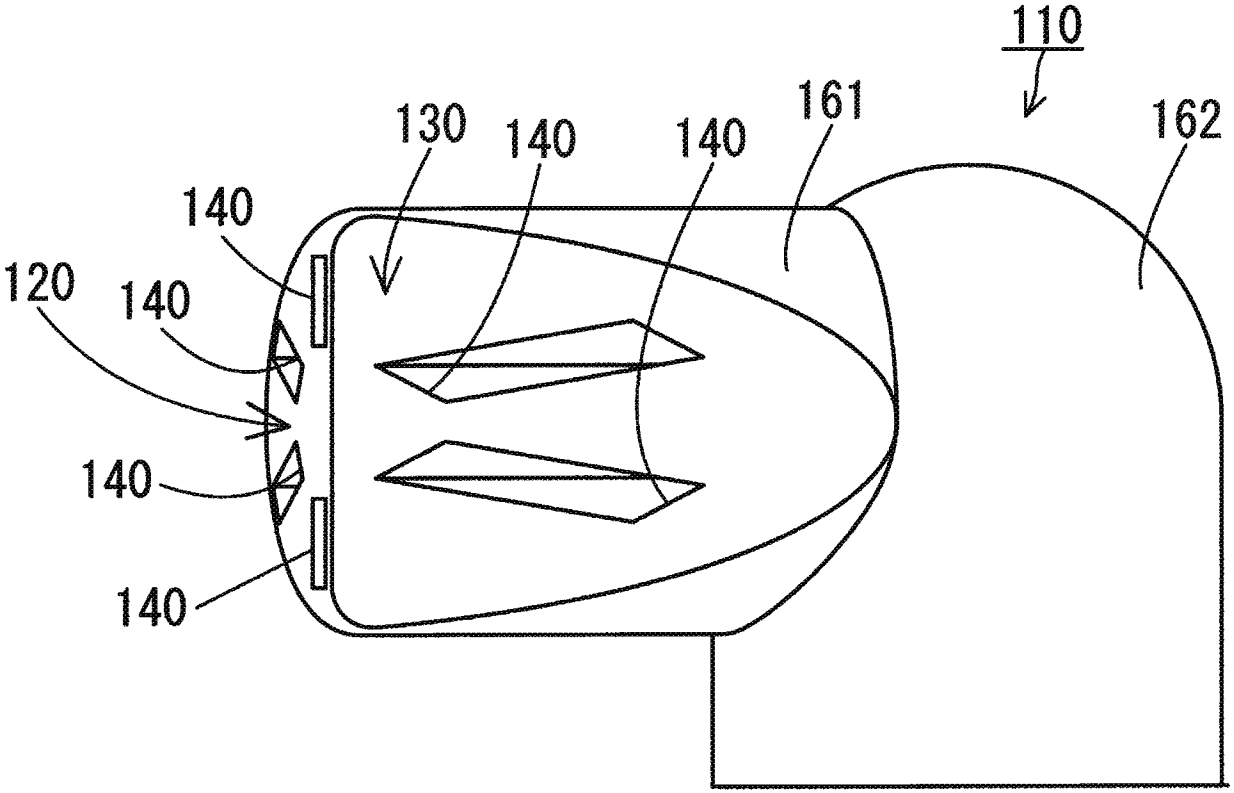
FIG. 6 is a side view of the nozzle.
Figure 7:
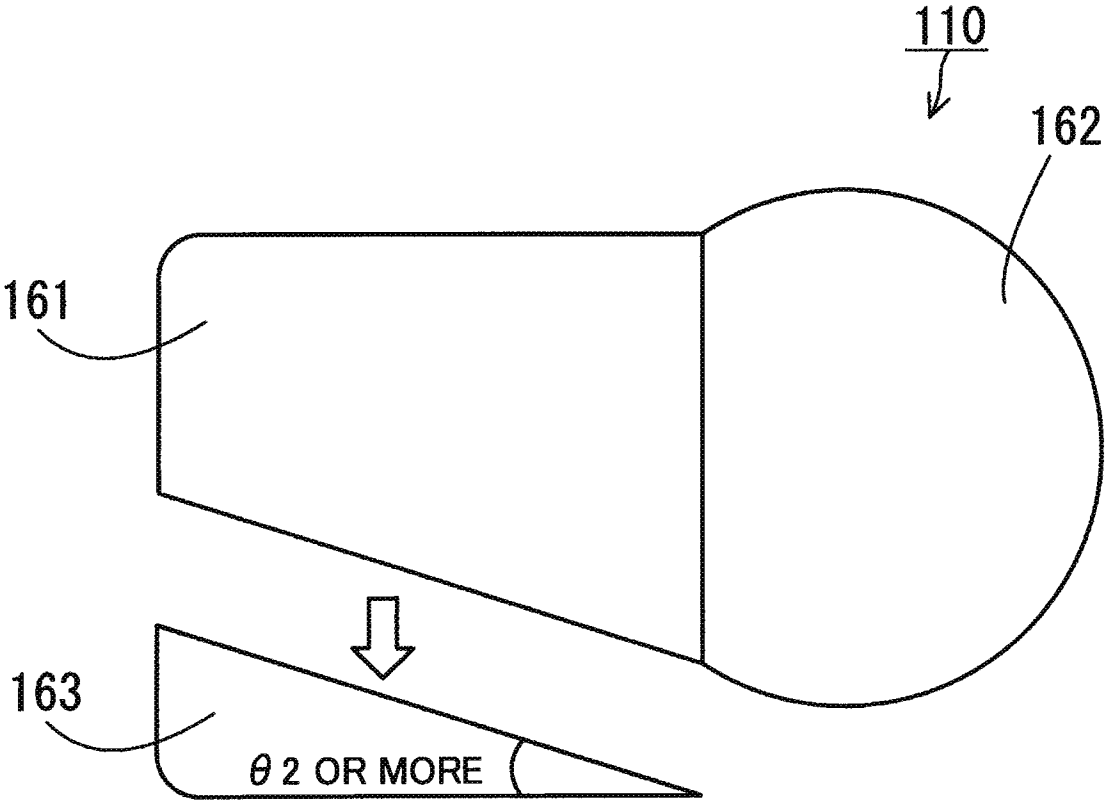
FIG. 7 is a schematic diagram explaining a producing method of the nozzle.

FIG. 5 is a front view showing the details of the nozzle element 110, FIG. 6 is a side view of the nozzle element 110, and FIG. 7 is a schematic diagram explaining a producing method of the nozzle element 110.

As shown in FIG. 5 and FIG. 6, the nozzle element 110 includes a cylindrical body 161 and a holder 162.

As shown in FIG. 6, the nozzle element 110 is held by the holder 162 in such a manner that the cylindrical body 161 is oriented in a direction substantially equal to the extending direction of the piping 180, and the nozzle element 110 is formed in an h-shape. The inside of the holder 162 is hollow for the sake of supplying the compressed air PA from the piping 180.

As shown in FIG. 5 and FIG. 6, the cylindrical body 161 includes a top surface 120 and a sloped portion 130. The sloped portion 130 is formed on the side opposite to the tongue rail 502, and is so formed as to approach the stock rail 501 (see FIG. 4), but no sloped portion 130 is formed on the side facing the stock rail 501.

As shown in FIG. 5 and FIG. 6, multiple slits 140 are so formed as to extend through the inside of the cylindrical body 161 in its central axis direction to the inner space of the holder 162, and the multiple slits 140 are radially arranged in the top surface 120 of the cylindrical body 161 around a center of a virtual circle of the top surface 120. Because no sloped portion 130 is formed on the side facing the stock rail 501, the slits 140 located on the side facing the stock rail 501 open in the top surface 120. Specifically, the slits 140 do not open toward the stock rail 501. In the present embodiment, each of the multiple slits 140 has a rectangular shape.

As shown in FIG. 7, during producing the nozzle elements 110, a cylindrical body having no sloped portion 130 is formed, and a member 163 is cut off at an angle of θ2 or more so as to obtain the cylindrical body 161 having the sloped portion 130.

Another Example

Figure 8:
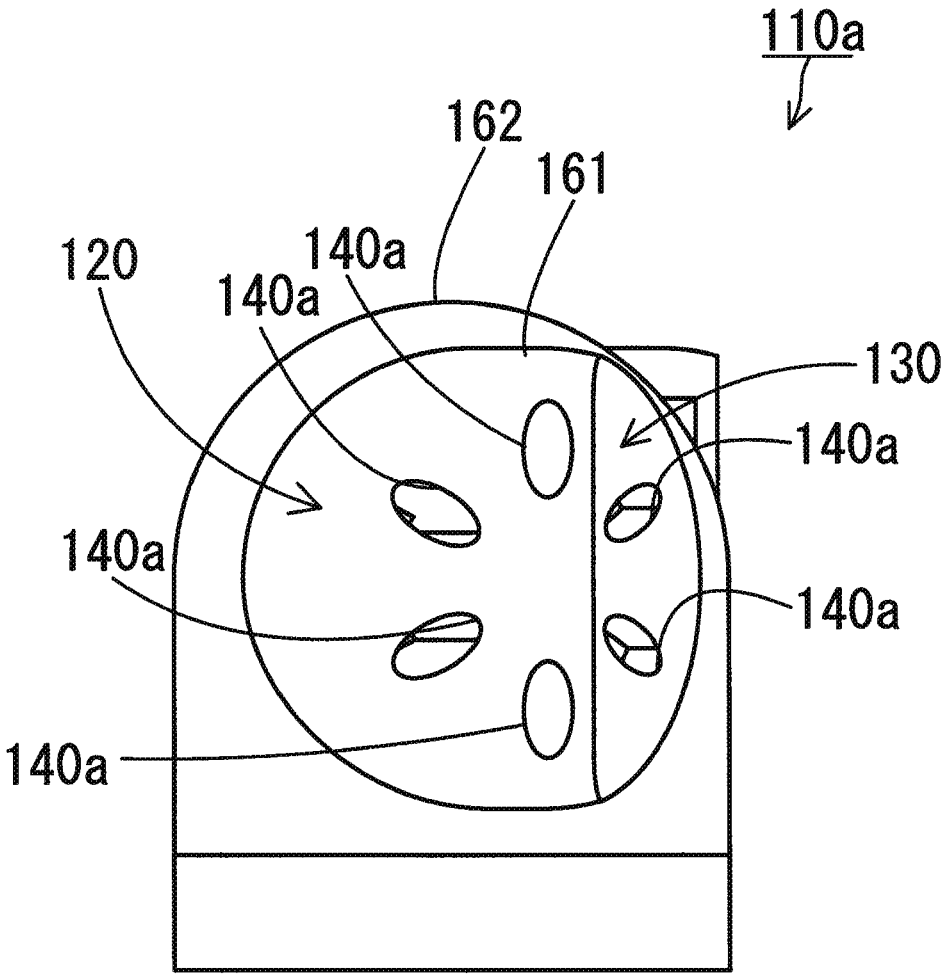
FIG. 8 is a drawing showing another example of multiple slits.
Figure 9:
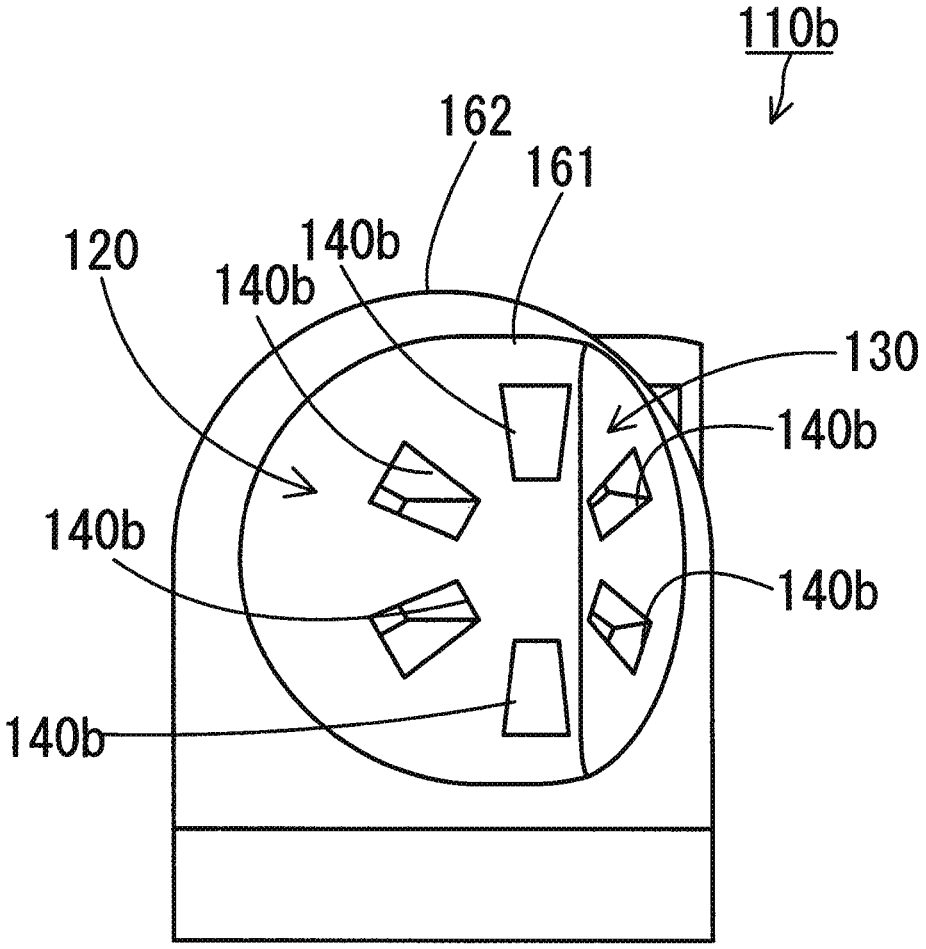
FIG. 9 is a drawing showing another example of the multiple slits.

As shown in FIG. 8, as the cross sectional shape of each slit 140, the slit 140 may be a slit 140*a* in an oval shape, or a slit. 140*b* in a trapezoidal shape as shown in FIG. 9. In addition, the slit may also have a triangle shape, or any other polygonal shape.

Figure 10:
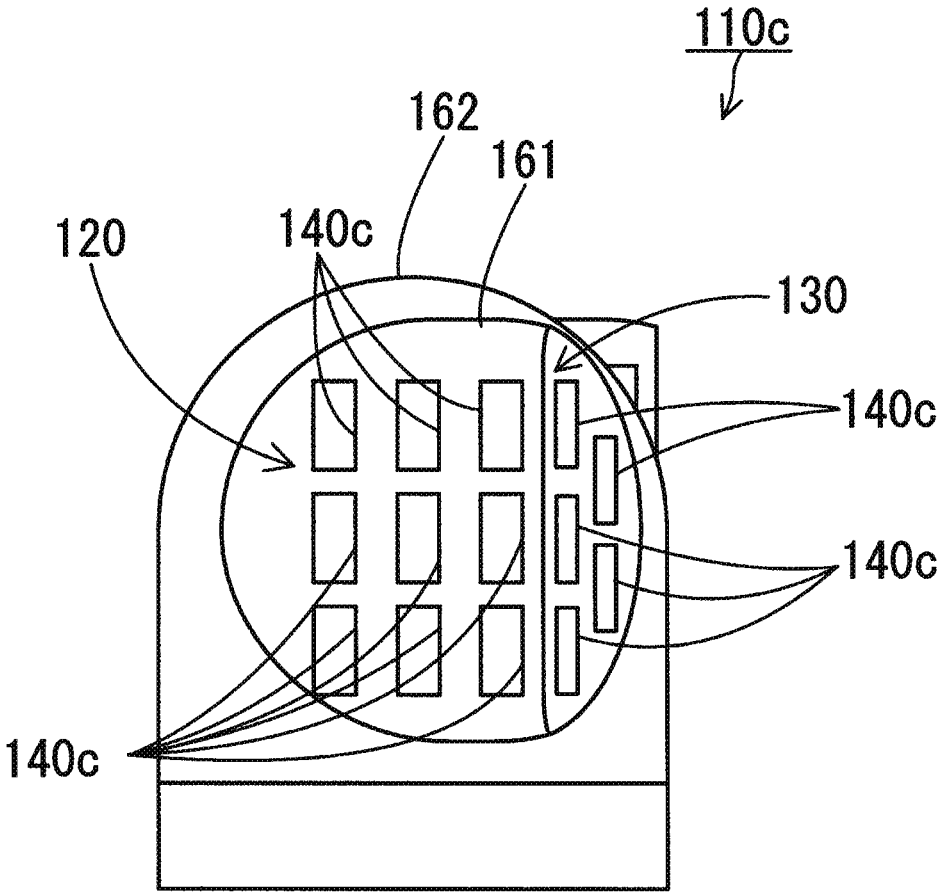
FIG. 10 is a drawing showing another example of the multiple slits.

As shown in FIG. 10, the multiple slits 140 may be arranged as multiple slits 140*c* in a staggered arrangement, or in a grid arrangement.

Figure 11:
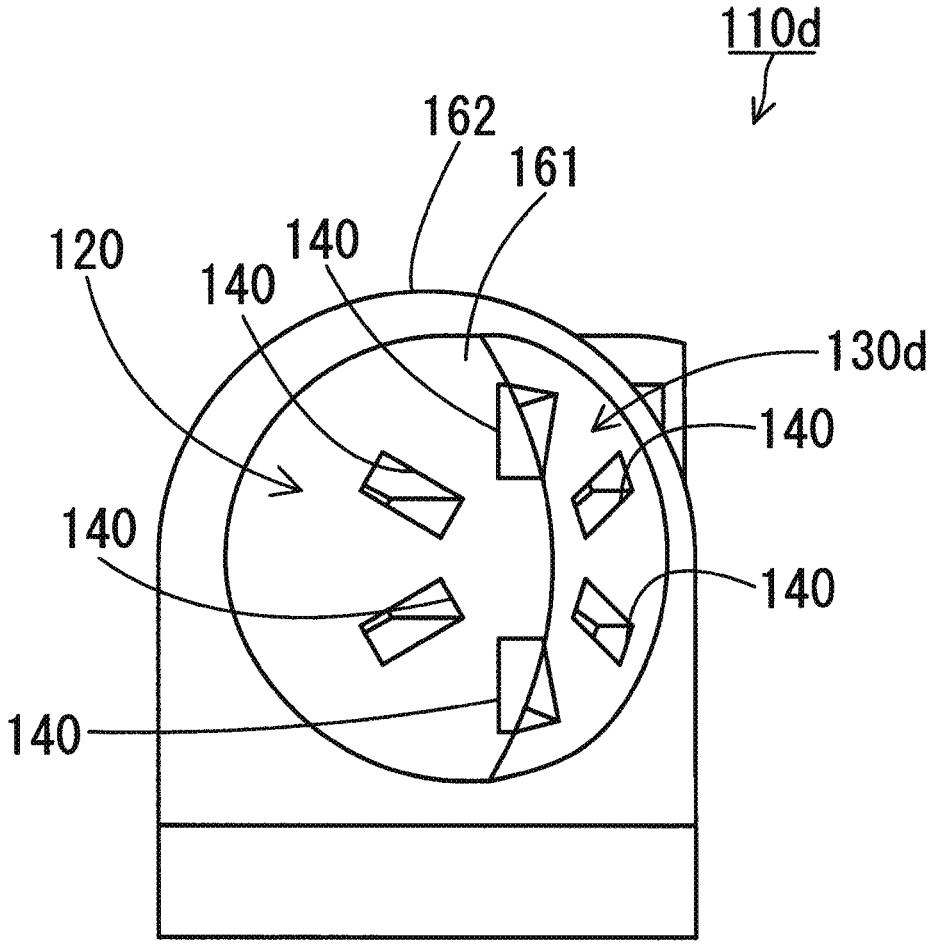
FIG. 11 is a drawing showing another example of a sloped portion.

As shown in FIG. 11, the sloped portion 130 may be a sloped portion 130*d* made of a curved surface having no plane shape but a conical side surface.

Figure 12:
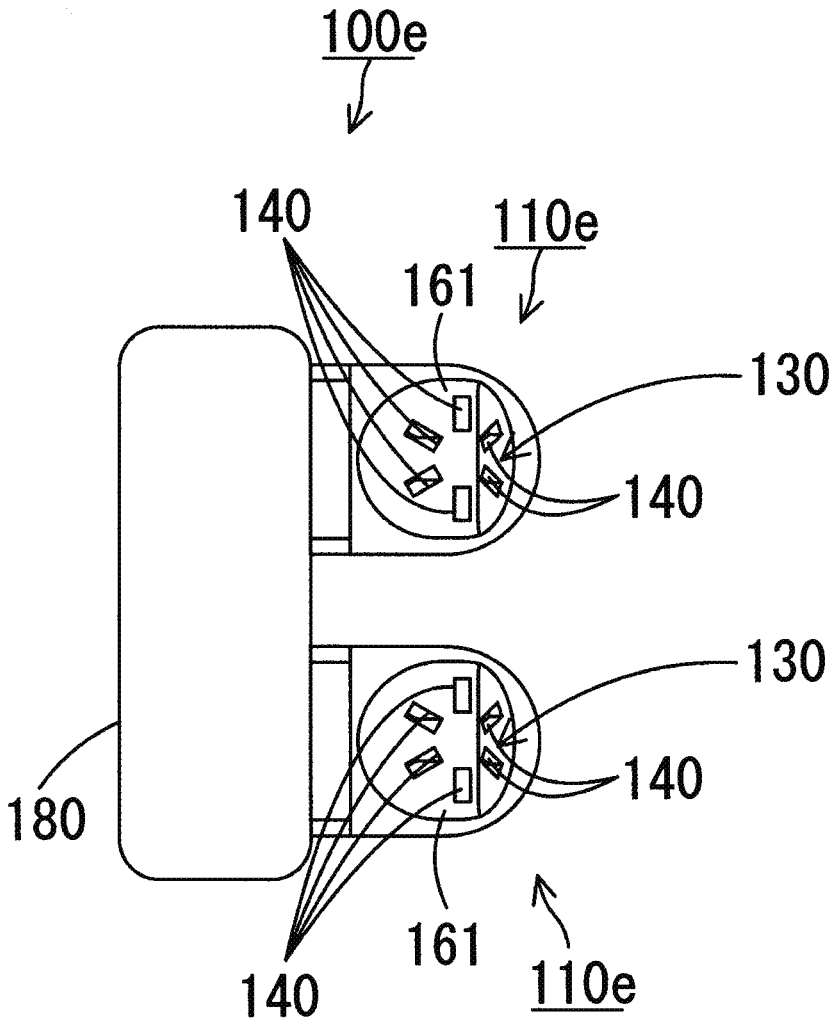
FIG. 12 is a drawing showing another example of the nozzle.

In addition, as shown in a nozzle for the foreign matter removing apparatus 100*e* in FIG. 12, nozzle elements 110*e* may be formed on the side surface of the piping 180. This configuration prevents the compressed air injected from the nozzle elements 110*e* from colliding with the piping 180, thereby suppressing the noises caused by this collision.

In the nozzle for the foreign matter removing apparatus 100, the sloped portion 130 is disposed on the side opposite to the tongue rail 502, and some of the multiple slits 140 open in the sloped portion 130; therefore, it is possible to significantly reduce the generation of the noises while securing pressure required for injecting the compressed air.

Specifically, a noise level can be reduced by half compared with the configuration of employing no sloped portion, and employing injection ports having simple round holes. Reduction in output of the compressed air is approximately 10% to 20%, and thus there is no practical problem, and there is almost no influence on the foreign matter removing performance.

As shown in FIG. 5 and FIG. 6, the radial arrangement of the multiple slits 140 can secure a longer distance between the two adjacent slits. Consequently, the compressed air injected from each slit 140 hardly interferes with each other, and the air flow hardly becomes disturbed, thereby further reducing the noises.

The nozzle elements 110 of the nozzle for the foreign matter removing apparatus 100 are configured to be commonly used by simply changing the title angle of each nozzle element 110 (θ1, θ2), alternately, which makes it easier to manage product components on the manufacturing basis.

In the present invention, the stock rail 501 is corresponding to a stock rail; the tongue rail 502 is corresponding to a tongue rail; the nozzles for the foreign matter removing apparatus 100, 100*e* are corresponding to a foreign matter removing apparatus at a track branch, and nozzles used in this apparatus; the compressed air PA is corresponding to compressed air; the piping 180 is corresponding to a piping unit; each of the nozzle element 110, the nozzle element 110*a*, the nozzle element 110*b*, the nozzle element 110*c*, the nozzle element 110*d*, and the nozzle element. 110*e* is corresponding to an injection nozzle element, respectively; the sloped portion 130 is corresponding to a sloped portion or a plane surface; the cylindrical body 161 is corresponding to a cylindrical housing; the slits 140, the slits 140*a*, the slits 140*b*, and the slits 140*c* are corresponding to slits, respectively; the angles θ1, θ2 are corresponding to a predetermined angle and also to an injection direction; the cylindrical body 161 is corresponding to a columnar housing; the top surface 120 is corresponding to a top surface; the slits 140*a* and 140*b* are corresponding to a rectangular shape and also to an oval shape; and the arrangement of the slits 140 is corresponding to radial arrangement of the multiple slits around the axial center.

Second Embodiment

Configuration of Track Branch

Figure 13:
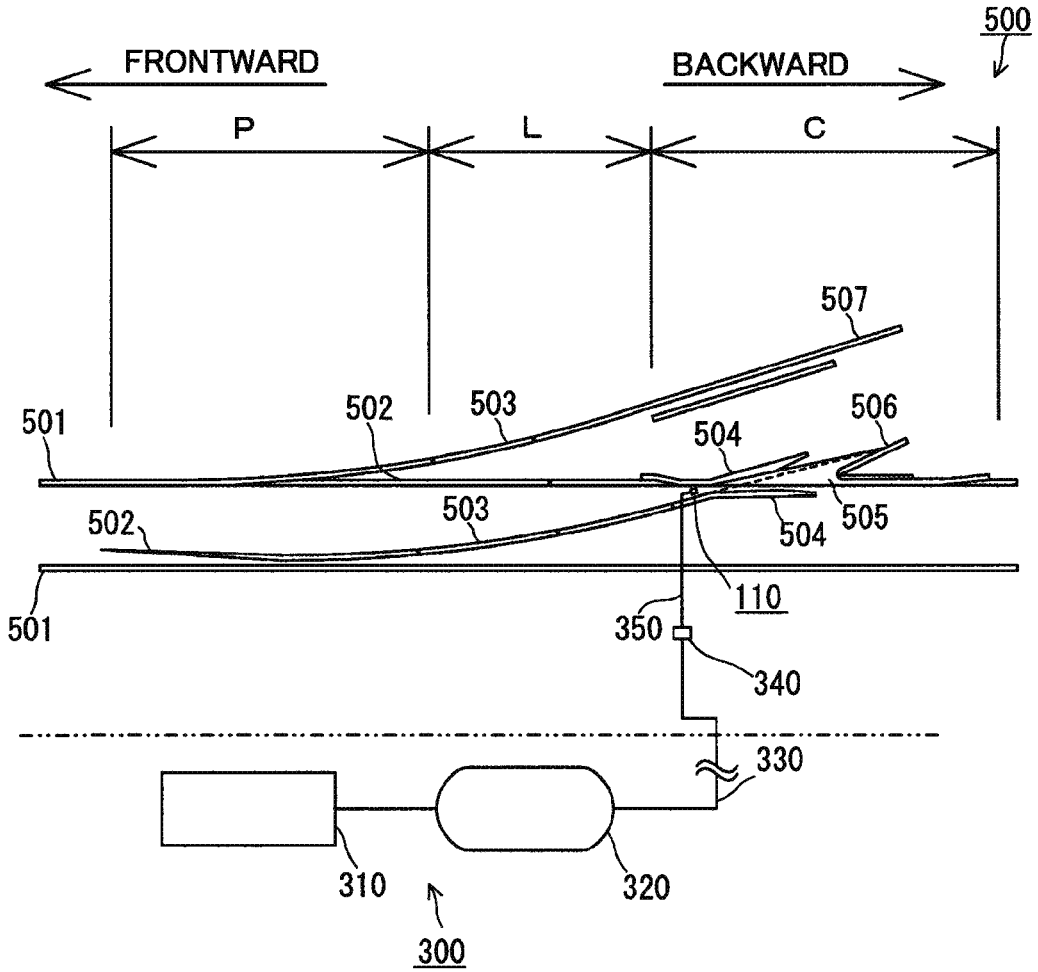
FIG. 13 is a schematic plan view showing an example of a configuration of a track branch according to the second embodiment.

FIG. 13 is a schematic plan view showing an example of a configuration of a track branch according to the present embodiment. As shown in FIG. 13, a track branch 500 are segmented into each region (point section P, lead section L, and crossing section C) in the track direction.

As shown in FIG. 13, the track branch 500 mainly includes a pair of stock rails 501, a pair of tongue rails 502, lead rails 503, wing rails 504, a movable rail 505, a fixing member 506, and main rails 507.

The point section P of FIG. 13 is configured as a region including a portion where the stock rails 501 come into contact with the tongue rails 502 at the front position of the track branch 500.

The crossing section C is configured as a region where the wing rails 504, the movable rail 505, and the fixing member 506 are disposed at the back position of the track branch 500.

The lead section L is configured as a region between the point section F and the crossing section C where the lead rails 503 are disposed at a portion where the point section P and the crossing section C are connected to each other.

In the present embodiment, the point section P and the leading section L form a frontward section located at the front position of the track branch 500, and the crossing section C is located at a backward section of the track branch 500 opposite to the frontward section, and forms a region including a portion where the rails intersect each other.

As shown in FIG. 13, the pair of the stock rails 501 are installed in accordance with a wheel width of a railway vehicle traveling over the rails with a constant distance therebetween. The pair of the tongue rails 502 capable of coming into contact with or apart from the pair of the stock rails 501 are installed so as to allow the vehicle to start branching away from the stock rails 501.

The stock rails 501 at the track branch 500 shown in FIG. 13 are disposed on railway sleepers via floor boards. The tongue rails 502 are configured to be movable on the railway sleepers via bearing floor boards. This configuration allows each tongue rail 502 to come into contact with or apart from the stock rail 501.

It is configured that the movable rail 505 of the crossing section C is allowed to be displaced along with the movement of the tongue rail 502 in accordance with the operation of the railway point (not shown), and becomes oscillatingly displaced using the fixing portion as a fulcrum structure so that the front end portion of the movable rail 505 comes into contact with or apart from the wing rail 504.

In general, at the track branch, a railway point (not shown) operates in accordance with an instruction from a controller (not shown) so that each tongue rail 502 moves in the direction of coming into contact with or apart from the stock rails 501, and the movable rail 505 moves at the same time, thereby carrying out a switching operation (point switching operation) on the traveling rails at the track branch 500. Accordingly, the railway vehicle can travel in the direction of the branch track line, or in the direction of the main track line.

(Configuration of Foreign Matter Removing Apparatus)

The foreign matter removing apparatus 300 equipped with a nozzle unit 110 for the foreign matter removing apparatus 300 according to the second embodiment will be described hereinafter. The foreign matter removing apparatus 300 is mounted to the wing rail 504 in the crossing section C at the track branch 500 as described above.

The foreign matter removing apparatus 300 equipped with the nozzle unit 110 for the foreign matter removing apparatus according to the present embodiment removes foreign matters such as snow and scattered stones having dropped to the wing rail 504, or to the wing rail 504 and the movable rail 505 by blowing the foreign matters away backward of the track branch 500, or by melting the snow through injection of the compressed air PA or the heated air HA from the nozzle unit 110. The present invention is not directed to sending the heated air HA; therefore description thereof will be omitted, hereinafter.

As shown in FIG. 13, the foreign matter removing apparatus 300 mainly includes the air supply device 310, the compression air tank 320, the nozzle unit 110, the air piping 330, the electromagnetic switching valve 340, and the nozzle piping 350.

The air supply device 310 shown in FIG. 13 is a compressed air supply device such as a compressor. Compressed air PA supplied from the air supply device 310 is accumulated in the compression air tank 320, and is supplied to the nozzle unit 110 via the air piping 330 and the nozzle piping 350 if the electromagnetic switching valve 340 is released.

Specifically, the controller (not shown) transmits a switching instruction for the electromagnetic switching valve 340 based on operation instruction signals transmitted from various equipment such as an operation signal of the railway point (point switching signal), or based on detection results from various sensors, such as a fall sensor (not shown) for fall of snow and foreign matters and a snowfall sensor (not shown). As a result, compressed air PA is injected from the nozzle unit 110 so as to remove the foreign matters. In response to the above point switching signal, a front end portion of each tongue rail 106 comes into contact with or apart from the stock rail 105 and the movable rail 109 comes into contact with or apart from the wing rail 108.

Not only in accordance with the aforementioned operation instruction signals and the detection results from the various sensors, but also during a time period such as vehicle operation time when the foreign matter removing operation is likely required, the controller (not shown) may be configured to transmit a switching instruction for the electromagnetic switching valve 340 so as to periodically inject the compressed air PA from the nozzle unit 110.

(Piping of Nozzle for the Foreign Matter Removing Apparatus)

Figure 14:
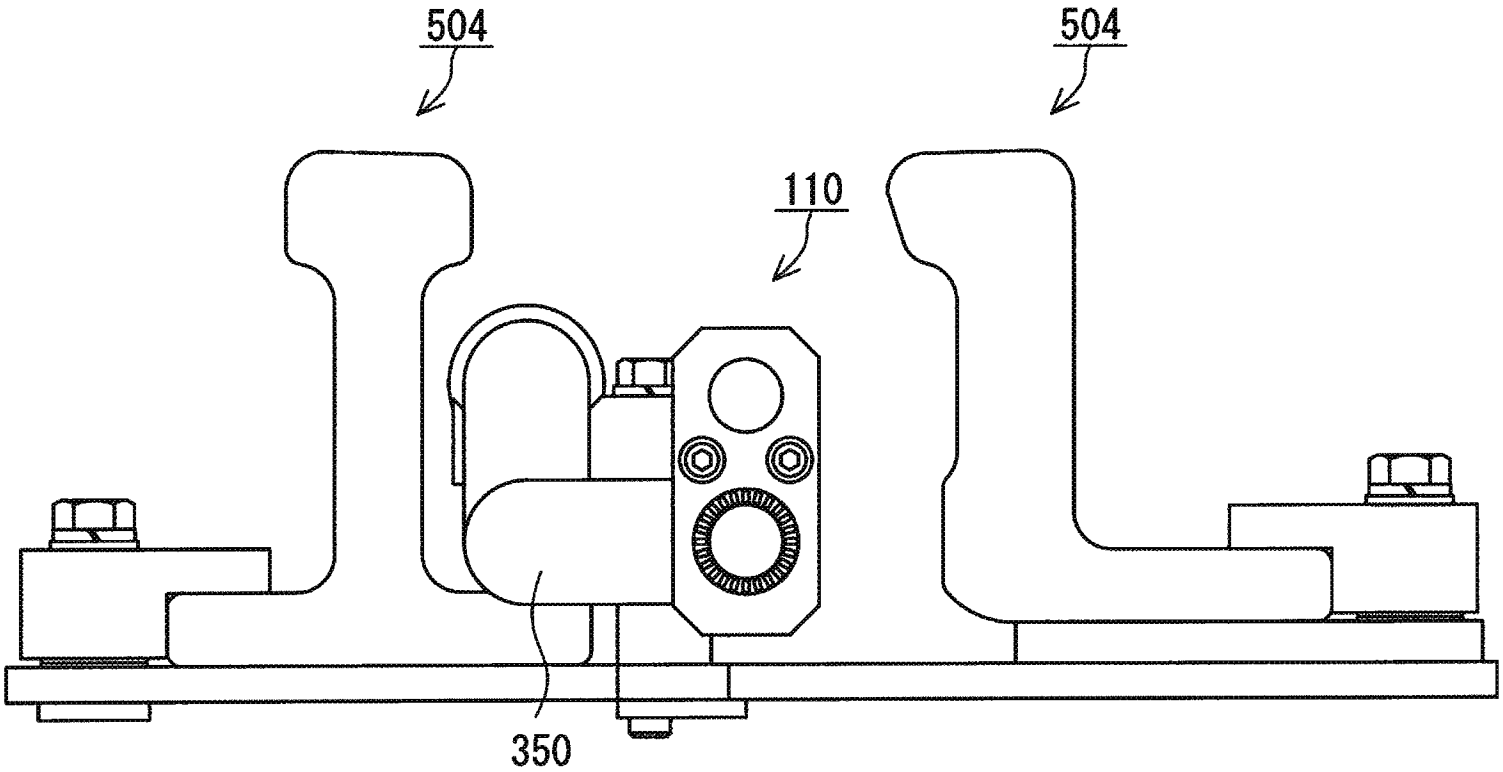
FIG. 14 is a schematic cross sectional view showing an example of a nozzle unit along with a wing rail viewed from the back to the front thereof.
Figure 15:
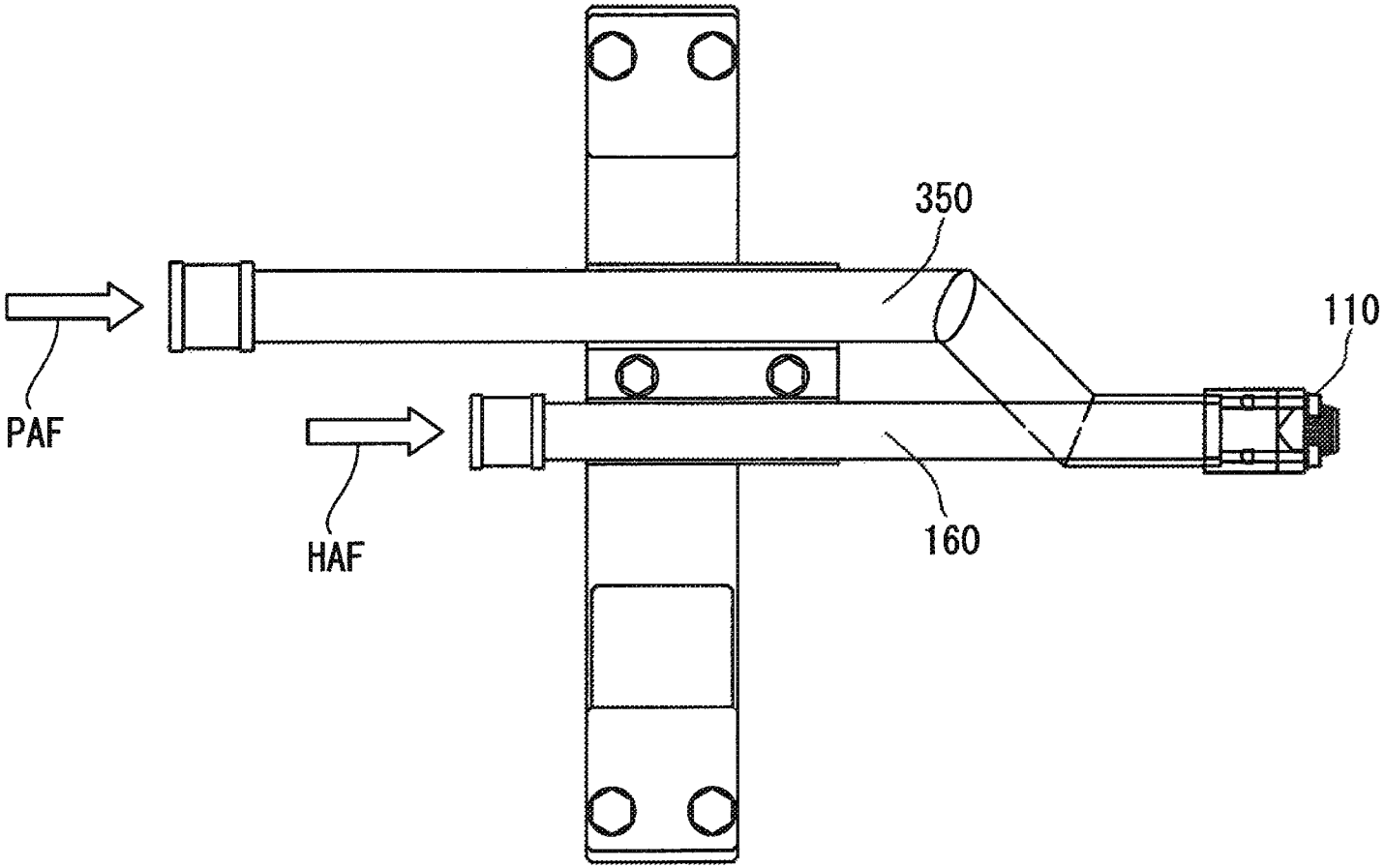
FIG. 15 is a schematic diagram of the nozzle unit viewed from a top surface thereof.

FIG. 14 is a schematic cross sectional view showing an example of the foreign matter removing apparatus 300 along with the wing rail 504 viewed from the back to the front, and FIG. 15 is a schematic diagram showing the nozzle unit 110 viewed from the top. As shown in FIG. 14, the nozzle unit 110 is disposed between the wing rails 504.

As shown in FIG. 15, the foreign matter removing apparatus 300 is equipped with the nozzle piping 350 and heated air piping 160. The downstream of the nozzle piping 350 is connected to the lower portion of the nozzle unit 110. The upstream of the heated air piping 160 is connected to a heated air generator (not shown), and the downstream thereof is connected to the upper portion of the nozzle unit 110.

As shown in FIG. 15, an air flow PAF of the compressed air PA is supplied to the nozzle piping 350, and an air flow HAP of the heated air HA is supplied to the heated air piping 160.

(Nozzle for Foreign Matter Removing Apparatus)

Figure 16:
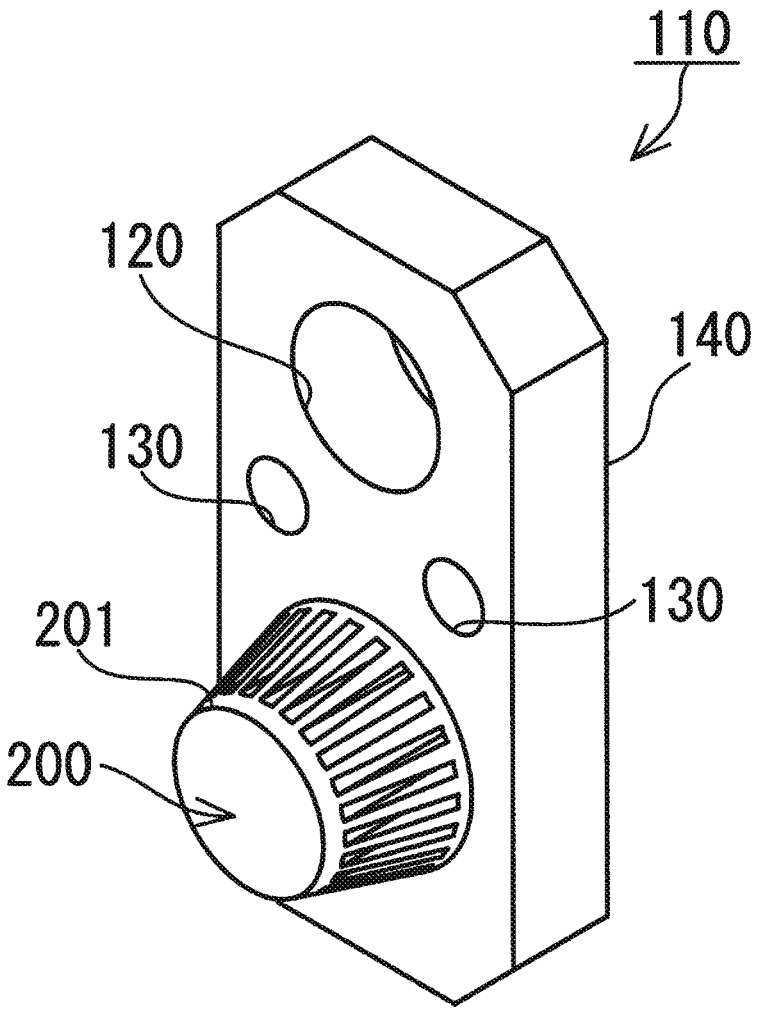
FIG. 16 is a schematic perspective view showing an example of a nozzle for the foreign matter removing apparatus.
Figure 17:
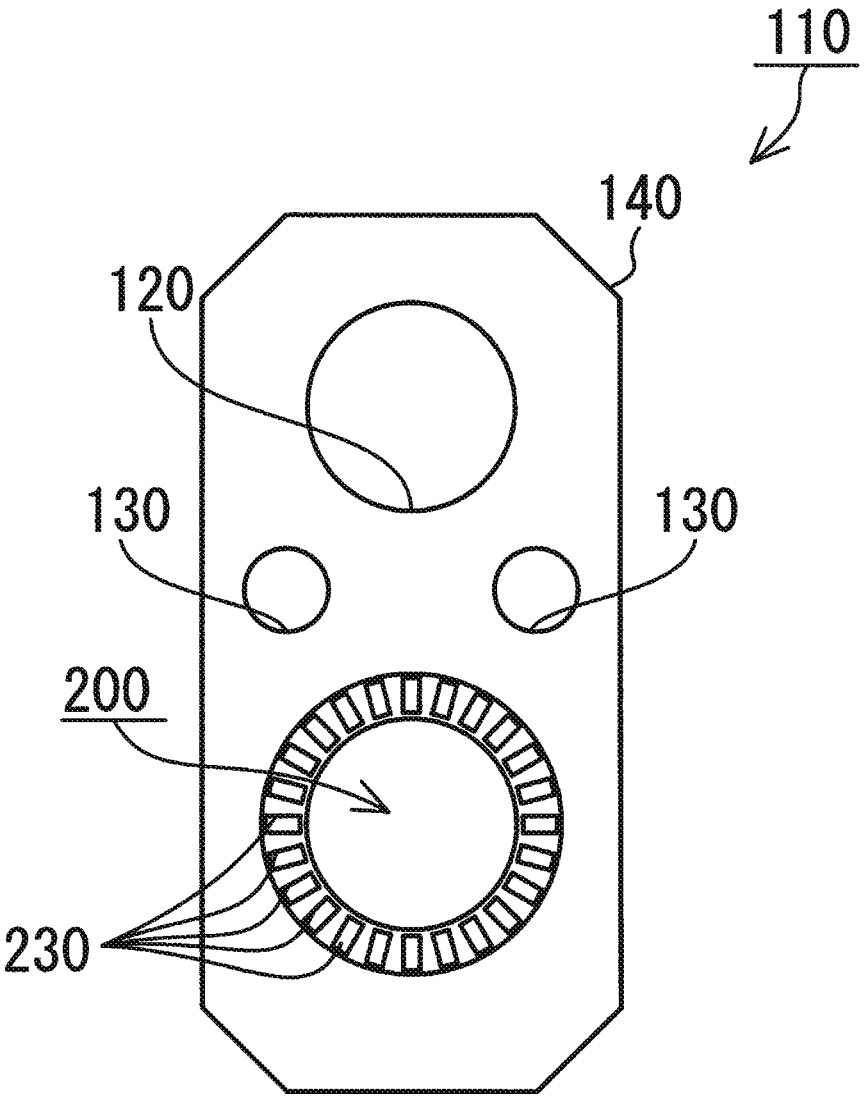
FIG. 17 is a schematic plan view showing an example of the nozzle for the foreign matter removing apparatus.
Figure 18:
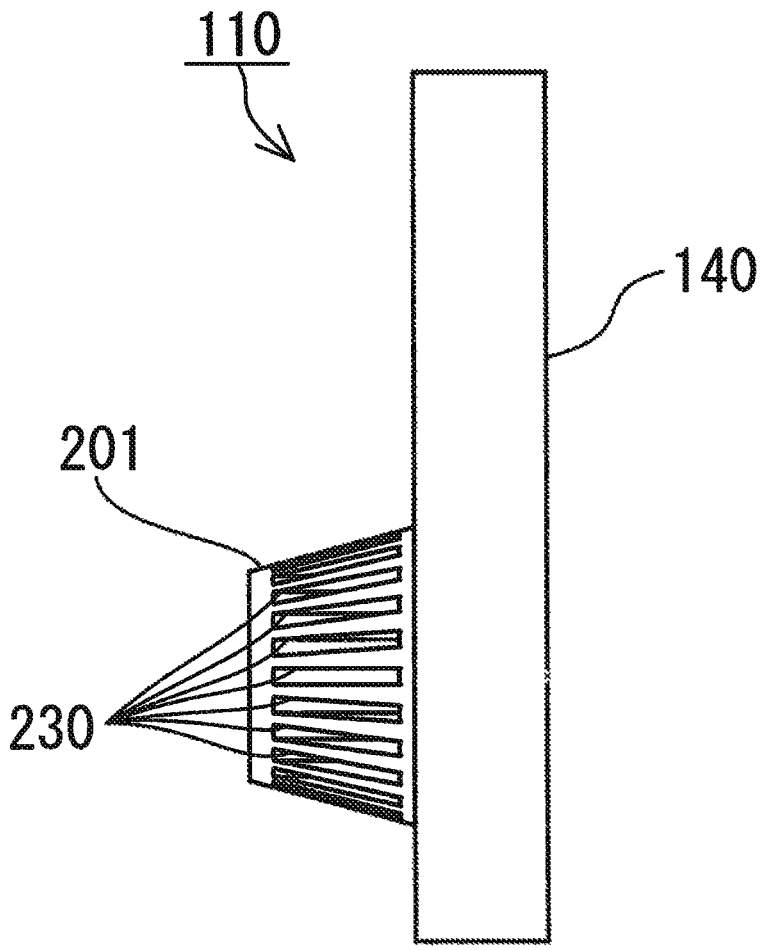
FIG. 18 is schematic side view showing an example of the nozzle for the foreign matter removing apparatus.
Figure 19:
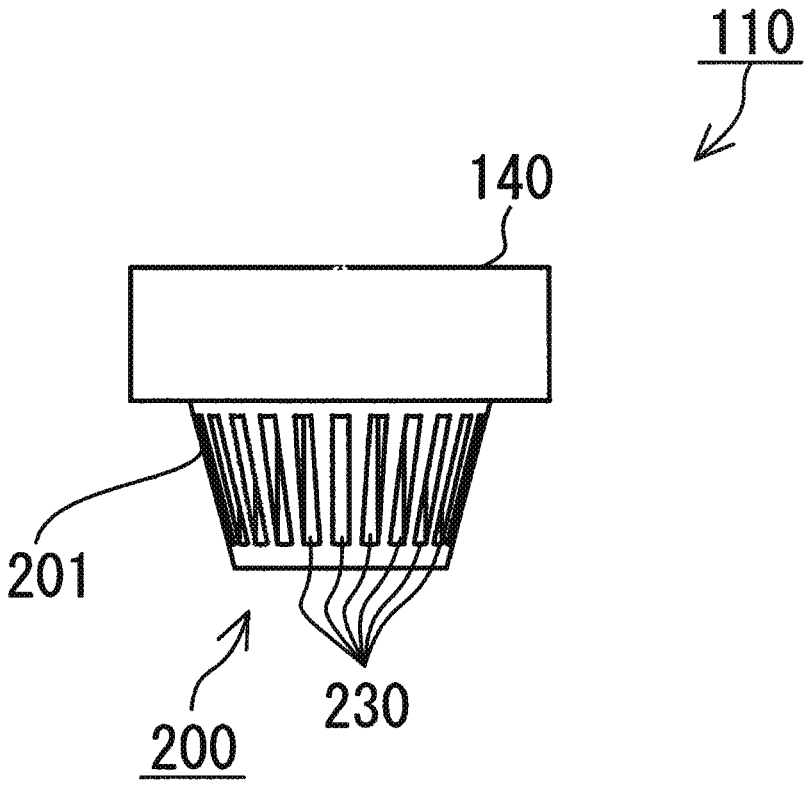
FIG. 19 is a schematic top view showing an example of the nozzle for the foreign matter removing apparatus.

FIG. 16 is a schematic perspective view showing an example of the nozzle unit 110 of the foreign matter removing apparatus 300, FIG. 17 is a schematic plan view showing an example of the nozzle unit 110 of the foreign matter removing apparatus 300, FIG. 18 is a schematic side view showing an example of the nozzle unit 110 of the foreign matter removing apparatus 300, and FIG. 19 is a schematic top view showing an example of the nozzle unit 110 of the foreign matter removing apparatus 300.

As shown in FIG. 16 to FIG. 19, the nozzle unit 110 of the foreign matter removing apparatus 300 includes a heated air nozzle port 120, front end nozzle fixing holes 130, a housing 140, an introduction port 141, and a nozzle 200.

As shown in FIG. 16, the heated air nozzle port. 120 is formed in the upper portion of the housing 140. The heated air HA supplied from the heated air piping 160 is injected from the heated air nozzle port 120. The introduction port. 141, and the nozzle 200 on the opposite side to the introduction port. 141 are disposed in the lower portion of the housing 140. The compressed air PA introduced from the introduction port 141 is injected from the nozzle 200 as described later. The nozzle unit 110 is fixed through the front end nozzle fixing holes 130.

(Detailed Structure of Nozzle)

Figure 20:
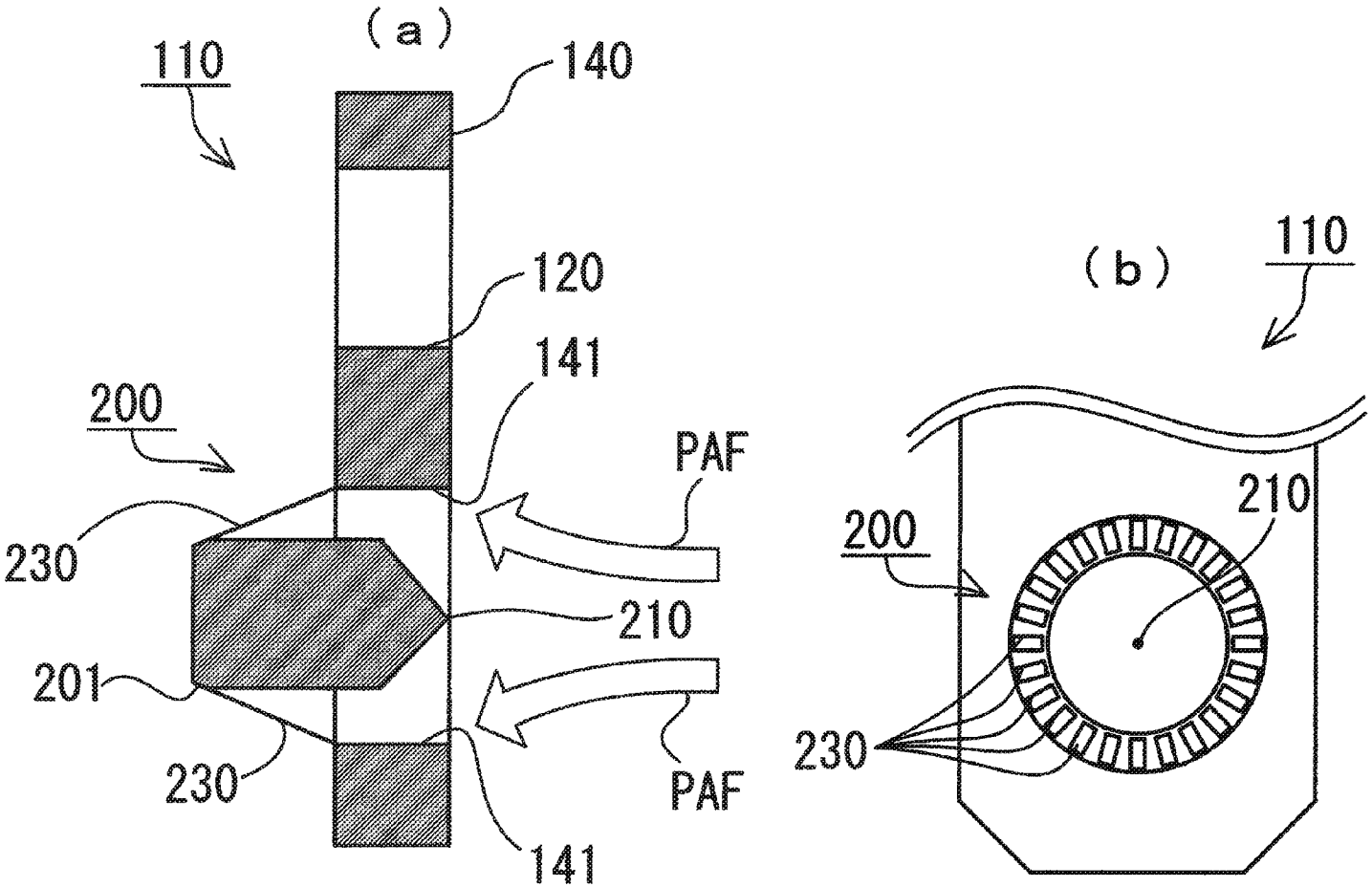
FIG. 20 is a schematic cross sectional view showing an example of a structure of the nozzle.

FIG. 20 is a schematic cross sectional view showing an example of the structure of the nozzle 200; FIG. 20 (*a*) shows a cross section of the nozzle 200, and FIG. 20(*b*) shows a state of the nozzle 200 viewed from the back surface thereof.

As shown in FIG. 16 to FIG. 20, the nozzle 200 is formed in a conical trapezoid 201 outwardly projecting from the housing 140, and multiple slits 230 are formed in the sloped surface of the conical trapezoid 201 such that the slits 230 are radially arranged around the central axis of the conical trapezoid 201. Each slit 230 is formed of a rectangular-shaped slit, but this shape may be an oval, a trapezoid, a triangle or any other polygon, or a combination thereof.

As shown in FIGS. 20(*a*) and (*b*), inside the nozzle 200, a guide 210 in a conical shape extending toward the introduction port 141 is disposed between the introduction port 141 of the compressed air PA and the multiple slits 230.

Consequently, the compressed air PA is smoothly guided in the direction of the air flow PAP by the guide 210, and can be injected from the multiple slits 230. Hence, it is possible to smoothly flow the compressed air PA without disturbing the air flow PAF of the compressed air PA, thereby greatly reducing the noises caused by the nozzle 200. Compared with another example of the nozzle structure described later, the guide 210 having a conical shape can further smoothen the compressed air PA in the direction of the air flow PAF toward every slit 230; therefore it is possible to minimize the noises.

(Another Example of Nozzle Structure)

Figure 21:
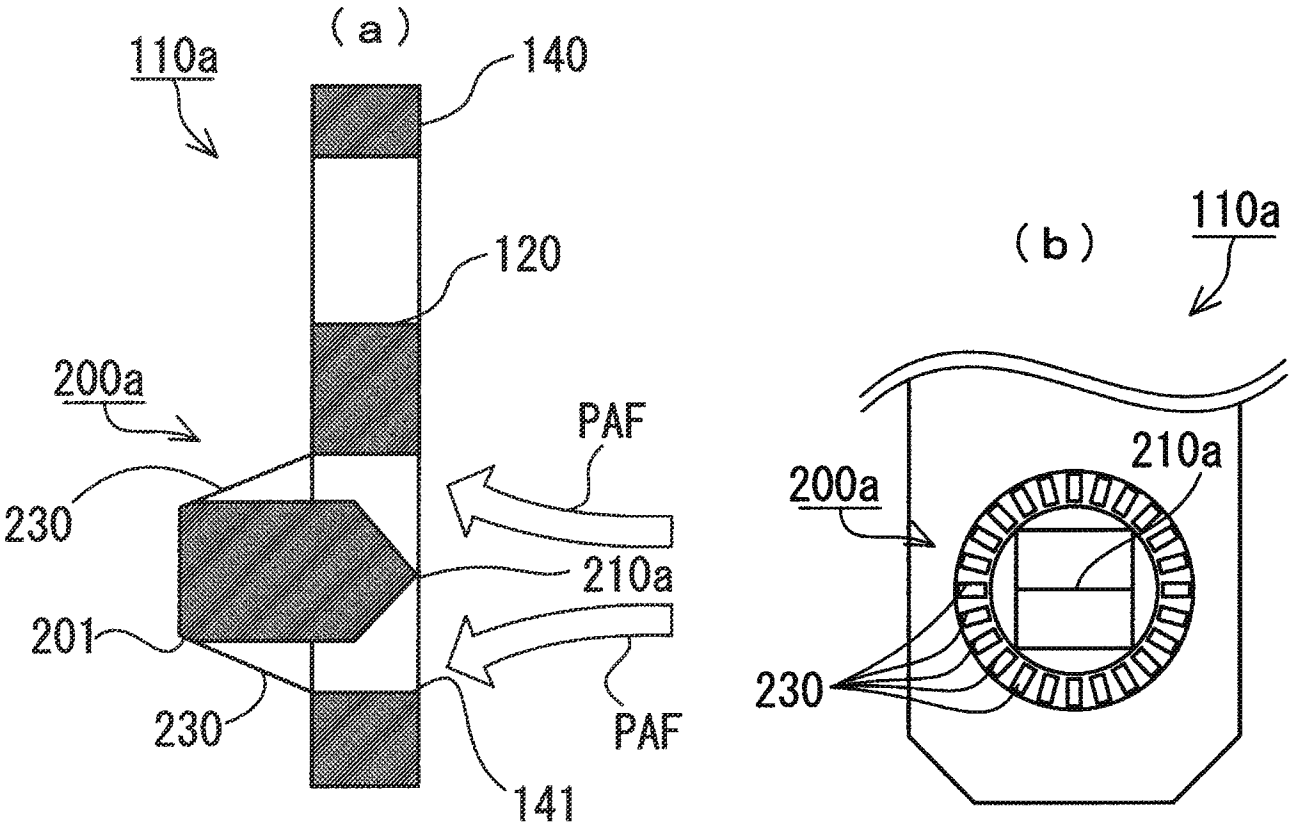
FIG. 21 is a schematic cross sectional view explaining another example of the nozzle.

As a nozzle unit 110*a* shown in FIG. 21, it may be configured to provide a nozzle 200*a* having a guide 210*a* whose sloped surfaces are formed of two plane surfaces extending toward the introduction port 141.

Figure 22:
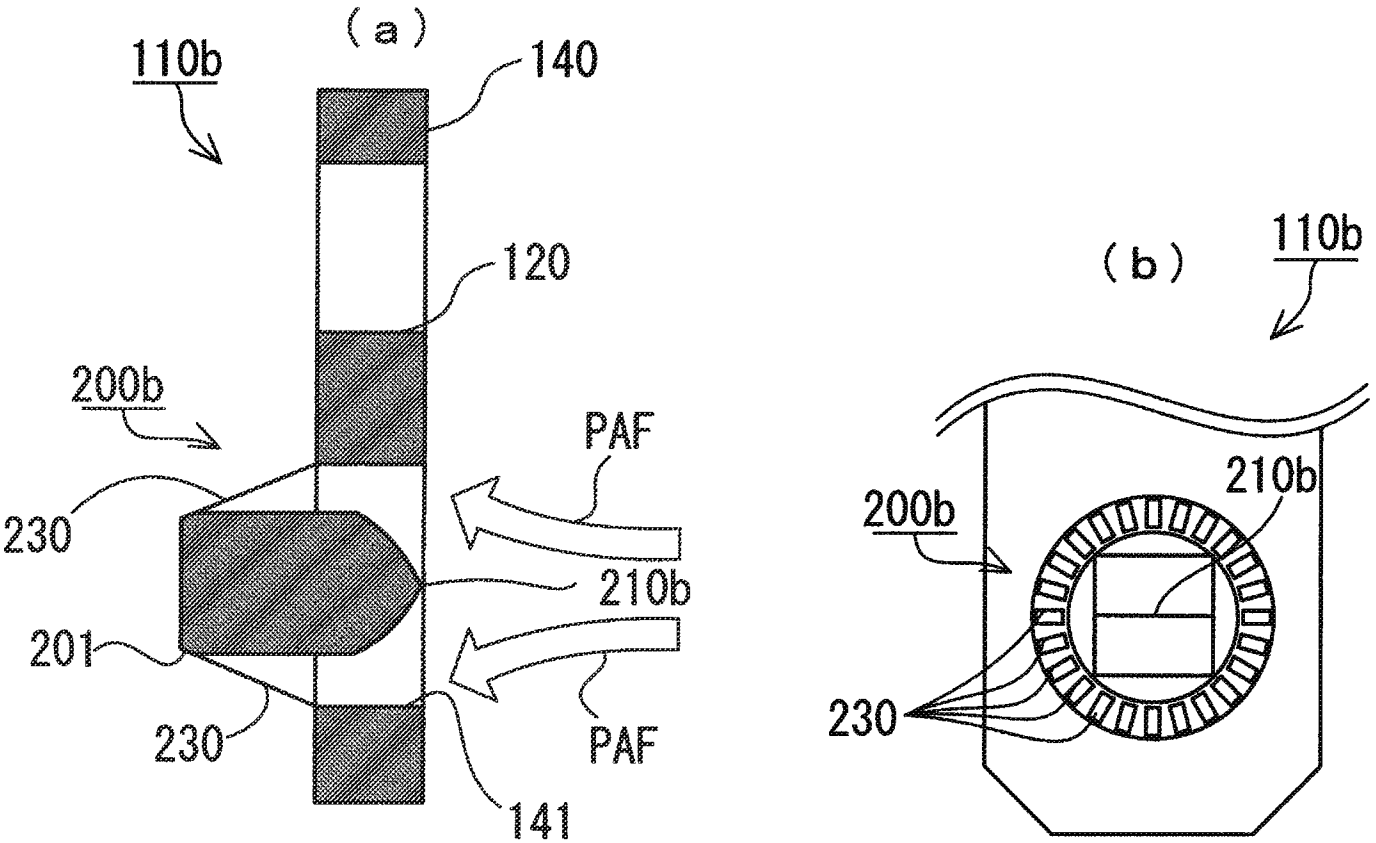
FIG. 22 is a schematic cross sectional view explaining another example of the nozzle.

As a nozzle unit 110*b* shown in FIG. 22, it may be configured to provide a nozzle 200*b* having a guide 210*b* whose sloped surfaces are formed of two curved surfaces extending toward the introduction port 141.

Each of the aforementioned nozzles may be formed by combining part of these nozzles. As another example of the nozzle structure, the guide is not limited to the guides 210, 210*a*, and 210*b*, and may also have a half-conical shape, a quadrangular pyramid shape or a part thereof, a circular truncated conical shape or a part thereof, and a truncated square pyramid shape or a part thereof other than a perfect conical shape.

In the present embodiment, the nozzle unit 110 is disposed at a single position, but the present invention is not limited to this, and any number of the nozzle units 110 may be provided.

The nozzle unit 110 is provided with a single nozzle 200, but the present invention is not limited to this, and the nozzle unit 110 may be provided with any number of the nozzles 200.

In the nozzle 200 of the foreign matter removing apparatus 300 according to the present embodiment, it is possible to flow the compressed air PA along the guide 210; therefore, abrupt collision of the compressed air PA with the inner wall of the injection housing can be suppressed, and disturbance of the air flow of the compressed air PA injected from the slits 230 can be reduced, as well. Accordingly, it is possible to significantly reduce the noises caused by injecting the compressed air PA while maintaining the pressure at the time of injecting the compressed air PA. In the other examples of the nozzle structure, it is possible to reduce the noises more than the prior art.

In the foreign matter removing apparatus 300 according to the present embodiment, the wing rail 504 is corresponding to a rail, the track branch 500 is corresponding to a track branch, the compressed air PA is corresponding to compressed air, the crossing section C is corresponding to a crossing section, the conical trapezoid. 201 is corresponding to an injection housing of a conical trapezoid, the slits 230 are corresponding to one or multiple slits, the introduction port. 141 is corresponding to a compressed air introduction port of the injection housing, each of the guides 210, 210*a*, and 210*b* is corresponding to a guide unit, respectively, and the nozzle 200 is corresponding to a nozzle for the foreign matter removing apparatus at a track branch.

One preferable embodiment of the present invention has been described as above, but the present invention is not limited thereto. It should be appreciated that other various embodiments can be accomplished without departing from the spirit and scope of the present invention. In addition, the operation and the effect attained by the configuration of the present invention have been described in the embodiments, but the above described operation and effect are examples thereof, and the present invention is not limited thereto.

The invention claimed is:

1. A foreign matter removing apparatus at a track branch for removing foreign matters having dropped between a stock rail and a tongue rail at the track branch, the foreign matter removing apparatus comprising:

a piping unit for supplying compressed air; and at least one injection nozzle element for injecting the compressed air supplied from the piping unit;

wherein the injection nozzle element comprises:

a cylindrical housing disposed on an opposite side of the injection nozzle element to the tongue rail, and having a sloped portion approaching more closely to the stock rail toward a nozzle front end of the injection nozzle element; and slits extending through an inside of the cylindrical housing in a central axis direction thereof so as to inject the compressed air, at least some of the slits opening in the sloped portion, and none of the slits opening toward the stock rail.

2. The foreign matter removing apparatus at a track branch according to claim 1 wherein, the sloped portion is formed by a plane surface extending from a top surface of the cylindrical housing toward a circumferential side surface thereof.

3. The foreign matter removing apparatus at a track branch according to claim 2 wherein, the piping unit comprises a rectangular tube disposed on a side surface of the stock rail opposite to the tongue rail, the injection nozzle element is disposed to one or both of an upper side and a lower side of the piping unit, and the plane surface of the sloped portion is provided within a projected area on an upper surface or on a bottom surface of the piping unit.

4. The foreign matter removing apparatus at a track branch according to claim 1 wherein, the slits are radially arranged at multiple positions around an axial center of the cylindrical housing.

5. The foreign matter removing apparatus at a track branch according to claim 1 wherein, a plurality of the injection nozzle elements each having the same shape are provided, and one of the injection nozzle elements has an injection direction different from an injection direction of another of the injection nozzle elements.

6. A nozzle for a foreign matter removing apparatus at a track branch mounted at a track branch of rails so as to remove foreign matters having dropped between rails by injecting compressed air, the nozzle for a foreign matter removing apparatus at a track branch comprising:

an injection housing of a conical trapezoid disposed at a front position of a crossing section where the rails intersect each other;

one or multiple slits formed in a side surface of the injection housing so as to inject the compressed air toward a back position of the crossing section; and a guide unit disposed between a compressed air introduction port of the injection housing and the one or multiple slits to guide the compressed air from the compressed air introduction port of the injection housing through an inside of the injection housing to the one or multiple slits.

7. The nozzle for a foreign matter removing apparatus according to claim 6, wherein the guide unit has a conical shape.

8. A nozzle used in a foreign matter removing apparatus at a track branch for removing foreign matters having dropped between a stock rail and a tongue rail at the track branch, the nozzle comprising:

a piping unit for supplying compressed air; and at least one injection nozzle element for injecting the compressed air supplied from the piping unit;

wherein the injection nozzle element comprises:

a cylindrical housing disposed on an opposite side of the injection nozzle element to the tongue rail, and having a sloped portion approaching more closely to the stock rail toward a nozzle front end of the injection nozzle element; and slits extending through an inside of the cylindrical housing in a central axis direction thereof so as to inject the compressed air, at least some of the slits opening in the sloped portion, and none of the slits opening toward the stock rail, and a central axis of the injection nozzle element is oriented from a direction along the stock rail toward the tongue rail at a predetermined angle.

* * * * *